US008033630B2

(12) United States Patent
Miyamoto et al.

(10) Patent No.: US 8,033,630 B2
(45) Date of Patent: Oct. 11, 2011

(54) LIQUID EJECTING METHOD AND LIQUID EJECTING APPARATUS

(75) Inventors: Toru Miyamoto, Shiojiri (JP); Hirokazu Nunokawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 535 days.

(21) Appl. No.: 12/013,737

(22) Filed: Jan. 14, 2008

(65) Prior Publication Data

US 2008/0211850 A1 Sep. 4, 2008

(30) Foreign Application Priority Data

Jan. 15, 2007 (JP) ..... 2007-006261

(51) Int. Cl.
*B41J 2/205* (2006.01)

(52) U.S. Cl. ..... 347/15; 347/5; 347/9; 347/12; 347/13; 347/14; 347/19

(58) Field of Classification Search ..... None
See application file for complete search history.

(56) References Cited

U.S. PATENT DOCUMENTS

| | | | |
|---|---|---|---|
| 6,905,186 | B2 | 6/2005 | Kojima |
| 7,207,647 | B2 | 4/2007 | Silverbrook |
| 7,246,871 | B2 | 7/2007 | Silverbrook |
| 7,289,246 | B2 | 10/2007 | Takahashi et al. |
| 7,347,523 | B2 | 3/2008 | Tatsumi |
| 7,407,264 | B2 | 8/2008 | Kuwahara et al. |
| 2004/0021724 | A1 | 2/2004 | Kojima |
| 2005/0073540 | A1 | 4/2005 | Silverbrook |
| 2005/0110824 | A1 | 5/2005 | Silverbrook |
| 2006/0125850 | A1 | 6/2006 | Kim et al. |
| 2006/0125860 | A1* | 6/2006 | Arazaki ..... 347/12 |
| 2006/0262155 | A1 | 11/2006 | Kuwahara et al. |
| 2008/0106564 | A1 | 5/2008 | Lifshitz et al. |
| 2008/0273060 | A1 | 11/2008 | Kuwahara et al. |

FOREIGN PATENT DOCUMENTS

| | | | |
|---|---|---|---|
| JP | 02-054676 | | 2/1990 |
| JP | 06-166247 | | 6/1994 |
| JP | 2004050430 | A | 2/2004 |
| JP | 2004122521 | A | 4/2004 |
| JP | 2006199048 | A | 8/2006 |
| JP | 2006272951 | A | 10/2006 |
| JP | 2007001141 | A | 1/2007 |
| WO | 2006006162 | A2 | 1/2006 |

OTHER PUBLICATIONS

European search report for corresponding European application 08250181.8 lists the references above, 2009.

* cited by examiner

*Primary Examiner* — Matthew Luu
*Assistant Examiner* — Justin Seo
(74) *Attorney, Agent, or Firm* — DLA Piper LLP (US)

(57) ABSTRACT

A liquid ejecting method includes detecting a faulty nozzle in which an ejection fault occurs when a liquid should be ejected, calculating corrected tone values by correcting tone values of pixels adjacent to pixels at which the liquid should be ejected from the faulty nozzle based on a correction amount, and a liquid ejecting apparatus ejecting the liquid to the adjacent pixels based on the corrected tone values.

10 Claims, 28 Drawing Sheets

| ROW REGION NUMBER | MEASUREMENT VALUES (YELLOW) | | |
|---|---|---|---|
| | 76 (30%) | 128 (50%) | 179 (70%) |
| 1 | Ya_1 | Yb_1 | Yc_1 |
| 2 | Ya_2 | Yb_2 | Yc_2 |
| 3 | Ya_3 | Yb_3 | Yc_3 |
| ⋮ | | ⋮ | |
| 115 | Ya_115 | Yb_115 | Yc_115 |
| 116 | Ya_116 | Yb_116 | Yc_116 |

CORRECTION VALUE TABLE FOR LEADING EDGE PRINTING

| ROW REGION NUMBER | YELLOW | | |
|---|---|---|---|
| | Sa | Sb | Sc |
| 1 | Ha_1 | Hb_1 | Hc_1 |
| 2 | Ha_2 | Hb_2 | Hc_2 |
| 3 | Ha_3 | Hb_3 | Hc_3 |
| ⋮ | | ⋮ | |
| 29 | Ha_29 | Hb_29 | Hc_29 |
| 30 | Ha_30 | Hb_30 | Hc_30 |

CORRECTION VALUE TABLE FOR ORDINARY PRINTING

| ROW REGION NUMBER | YELLOW | | |
|---|---|---|---|
| | Sa | Sb | Sc |
| 1 | Ha_1 | Hb_1 | Hc_1 |
| 2 | Ha_2 | Hb_2 | Hc_2 |
| 3 | Ha_3 | Hb_3 | Hc_3 |
| 4 | Ha_4 | Hb_4 | Hc_4 |
| 5 | Ha_5 | Hb_5 | Hc_5 |
| 6 | Ha_6 | Hb_6 | Hc_6 |
| 7 | Ha_7 | Hb_7 | Hc_7 |

CORRECTION VALUE TABLE FOR TRAILING EDGE PRINTING

| ROW REGION NUMBER | YELLOW | | |
|---|---|---|---|
| | Sa | Sb | Sc |
| 1 | Ha_1 | Hb_1 | Hc_1 |
| 2 | Ha_2 | Hb_2 | Hc_2 |
| 3 | Ha_3 | Hb_3 | Hc_3 |
| ⋮ | | ⋮ | |
| 29 | Ha_29 | Hb_29 | Hc_29 |
| 30 | Ha_30 | Hb_30 | Hc_30 |

FIG. 16

INTERLACED PRINTING METHOD

| CORRECTION AMOUNT R | YELLOW | MAGENTA | CYAN | BLACK |
|---|---|---|---|---|
| Sd=102(40%) | Ryd | Rmd | Rcd | Rkd |
| Se=179(70%) | Rye | Rme | Rce | Rke |
| Sf=255(100%) | Ryf | Rmf | Rcf | Rkf |

PRINTING MODE SETTING

○ HIGH SPEED PRINTING MODE
FAULTY NOZZLE TESTING IS NOT CARRIED OUT

◉ HIGH QUALITY IMAGE MODE
CLEANING CARRIED OUT IF THERE IS A FAULTY NOZZLE

○ STANDARD MODE
CLEANING CARRIED OUT DEPENDING ON CONDITIONS IF THERE IS A FAULTY NOZZLE

HELP OK CANCEL

FIG. 23

OVERLAP PRINTING METHOD

LIQUID EJECTING METHOD AND LIQUID EJECTING APPARATUS

CROSS-REFERENCE TO RELATED APPLICATIONS

The present application claims priority upon Japanese Patent Application No. 2007-006261 filed on Jan. 15, 2007, which is herein incorporated by reference.

BACKGROUND

1. Technical Field

The present invention relates to liquid ejection methods and liquid ejection apparatuses.

2. Related Art

Inkjet printers are known in which a head is moved in a movement direction and a printed image is accomplished by causing ink to be ejected from nozzles during that movement.

In these printers, sometimes the ink droplets do not land in the correct position on the medium due to problems such as the processing precision of the nozzles. When this happens, shading variations occur in the vicinity of the region in which the ink droplets should have landed and stripe shaped density irregularities are produced in the printed image.

Accordingly, methods have been proposed to remedy these density irregularities by sampling an image using a CCD sensor and correcting the data to be outputted by the inkjet printer based on gain irregularity characteristics of the CCD sensor (See JP-A-2-54676).

Other methods are also proposed in which density irregularity test patterns are printed and density irregularity correction is carried out based on density data of the density irregularity test patterns (See JP-A-6-166247).

If a faulty nozzle, which cannot perform ejection when ink droplets should be ejected, occurs during printing, dots will not be formed in positions where the intended dots should have been formed. In this case, density irregularities will be produced in the printed image even if correction had been carried out of density irregularities due to problems such as the processing precision of the nozzles.

Also, although the faulty nozzle may be recovered by cleaning the nozzle face, the printing time will be lengthened by the time required for cleaning.

SUMMARY

Accordingly, an advantage of the present invention is to shorten the printing time as much as possible without producing density irregularities when a faulty nozzle has occurred.

In order to achieve this object, a liquid ejecting method according to the present invention includes: detecting a faulty nozzle in which an ejection fault occurs when a liquid should be ejected; calculating corrected tone values by correcting tone values of pixels adjacent to pixels at which the liquid should be ejected from the faulty nozzle based on a correction amount; and a liquid ejecting apparatus ejecting the liquid to the adjacent pixels based on the corrected tone values.

Features of the invention other than the above will become clear by reading the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings wherein:

FIG. 16 is an explanatory diagram of a correction value table for the yellow ink nozzle row;

FIG. 23 shows a screen in which the user sets a printing method;

DESCRIPTION OF EXEMPLARY EMBODIMENTS

Figure 1:
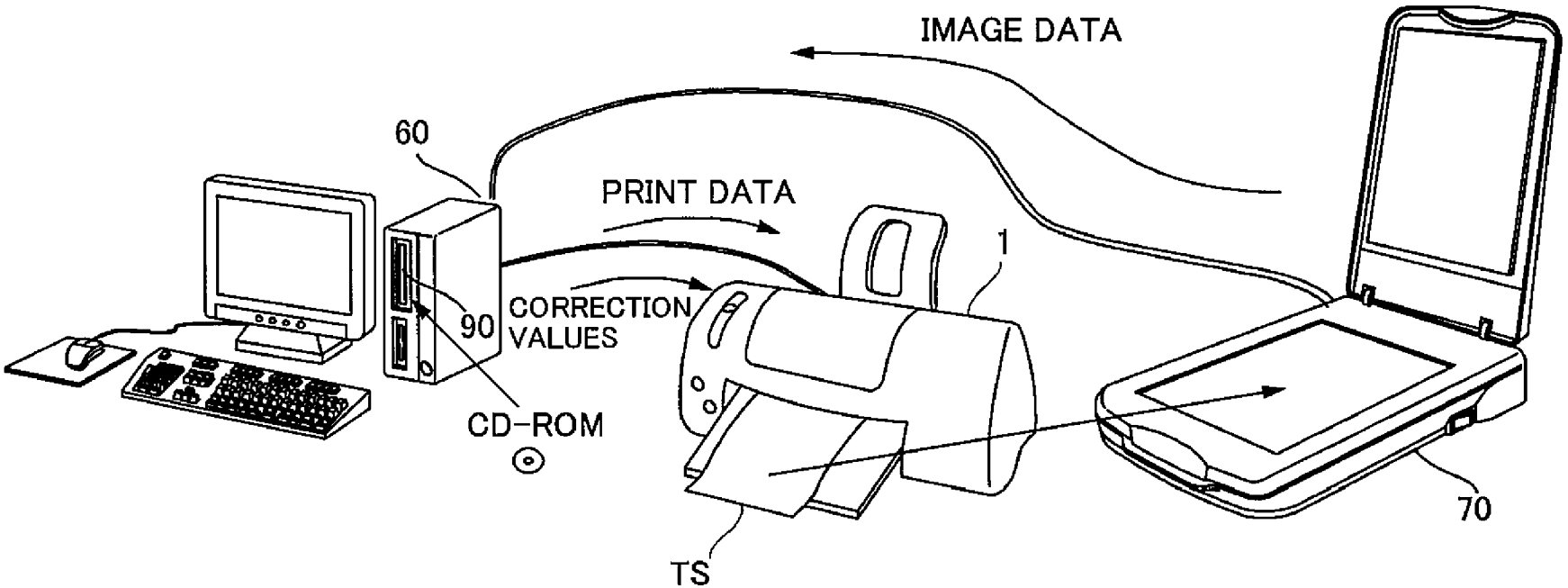
FIG. 1 shows a system configuration of the present embodiment.

At least the following matters will be made clear by the explanation in the present specification and the description of the accompanying drawings.

Namely, a liquid ejecting method can be achieved including: detecting a faulty nozzle in which an ejection fault occurs when a liquid should be ejected; calculating corrected tone values by correcting tone values of pixels adjacent to pixels at which the liquid should be ejected from the faulty nozzle based on a correction amount; and a liquid ejecting apparatus ejecting the liquid to the adjacent pixels based on the corrected tone values.

With this liquid ejecting method, the density of pixels to which a faulty nozzle has been assigned can be compensated using adjacent pixels. As a result, it is possible to prevent white (light density) streaks being produced undesirably in the completed image. Furthermore, since the density of pixels to which a faulty nozzle has been assigned can be remedied without carrying out cleaning, the cleaning time can be reduced and the consumption of ink used in cleaning can be suppressed.

In this liquid ejecting method, the corrected tone values are tone values darker than tone values of the adjacent pixels.

With this liquid ejecting method, the density of pixels to which a faulty nozzle has been assigned can be compensated by making the density of adjacent pixels darker.

In this liquid ejecting method, the liquid ejecting apparatus forms a test pattern in which pixel rows that are a plurality of pixels lined up in a predetermined direction and indicate a same instructed tone value are lined up in a direction that intersects the predetermined direction, the test pattern is read by a scanner and a read tone value is obtained for each pixel row, a first correction value for each pixel row is calculated from the read tone value and the instructed tone value, tone values indicating the pixel rows are corrected using the first correction value, the liquid is ejected to the pixel rows based on the corrected tone values, and when the faulty nozzle is detected, the tone values of the adjacent pixels are corrected by second correction values in which the correction amounts have been added to the first correction values, and the corrected tone values are calculated.

With this liquid ejecting method, not only density irregularities produced by faulty nozzles, but also density irregularities that occur due to problems such as the processing precision of the nozzles can be remedied.

In this liquid ejecting method, when a single nozzle ejects the liquid in the pixel row, the adjacent pixels are pixels adjacent in a direction intersecting pixels at which the liquid should be ejected from the faulty nozzle.

With this liquid ejecting method, the density of pixels to which a faulty nozzle has been assigned can be compensated using adjacent pixels. For example, even if the tone values of pixels adjacent in the predetermined direction to pixels at which the faulty nozzle has been assigned are corrected, since the nozzle assigned to the adjacent pixel in the predetermined direction is also a faulty nozzle, the density of certain pixels cannot be compensated.

In this liquid ejecting method, when there are two or more nozzles that eject the liquid in the pixel row, the adjacent pixels are pixels adjacent in the predetermined direction and the intersecting direction to pixels at which the liquid should be ejected from the faulty nozzle.

With this liquid ejecting method, the density of pixels to which a faulty nozzle has been assigned can be compensated using adjacent pixels.

In this liquid ejecting method, the correction amounts are calculated using a first test pattern, in which the liquid has been ejected from all nozzles of a plurality of nozzles that should eject the liquid in order to form the test pattern, and a second test pattern, in which the liquid has been ejected from nozzles other than a certain nozzle of the plurality of nozzles.

With this liquid ejecting method, correction amounts can be calculated for correcting the density of pixels to which a faulty nozzle has been assigned.

In this liquid ejecting method, when non-ejection pixel rows, which are pixel rows in which the liquid is not ejected of the pixel rows constituting the second test pattern, are multiple, nozzles associated with the plurality of non-ejection pixel rows are respectively different nozzles.

With this liquid ejecting method, correction amounts can be calculated without being influenced by characteristics of any particular nozzle.

In this liquid ejecting method, the correction amounts are set such that tone values of the corrected tone values become darker, the darker the tone values of pixels at which the liquid should be ejected from the faulty nozzle.

With this liquid ejecting method, the density of pixels to which liquid should be ejected from a faulty nozzle can be further corrected by making the correction amount larger and making the density of adjacent pixels darker.

In this liquid ejecting method, when nozzles assigned to the adjacent pixels are the faulty nozzle, a recovery process is carried out so that liquid is ejected normally from the faulty nozzle.

With this liquid ejecting method, liquid is ejected normally from faulty nozzles and it is possible to prevent white (light density) streaks being produced undesirably in the completed image. In a case such as this where the pixels at which faulty nozzle are assigned are neighboring and the density of the pixels to which a faulty nozzle has been assigned cannot be corrected even if the tone values of adjacent pixels are corrected, image deterioration is prevented by carrying out cleaning.

In this liquid ejecting method, the corrected tone values are calculated by adding the correction amount to the tone values of the adjacent pixels.

With this liquid ejecting method, the density of pixels to which a faulty nozzle has been assigned can be compensated using adjacent pixels.

Furthermore, a liquid ejecting apparatus is achieved, provided with nozzles that eject a liquid; a detection mechanism that detects a faulty nozzle in which an ejection fault occurs when the liquid should be ejected; and a controller that calculates corrected tone values by correcting tone values of pixels adjacent to pixels at which the liquid should be ejected from the faulty nozzle based on a correction amount, and that causes to eject the liquid at the adjacent pixels based on the corrected tone values.

With this liquid ejecting apparatus, the density of pixels to which a faulty nozzle has been assigned can be compensated using adjacent pixels. Furthermore, the cleaning time can be shortened and consumption of ink used in cleaning can be suppressed.

Also, a program is achieved for achieving the liquid ejecting apparatus, including detecting a faulty nozzle in which an ejection fault occurs when a liquid should be ejected, calculating corrected tone values by correcting tone values of pixels adjacent to pixels at which the liquid should be ejected from the faulty nozzle based on a correction amount, and a liquid ejecting apparatus ejecting the liquid to the adjacent pixels based on the corrected tone values.

With this program, the density of pixels to which a faulty nozzle has been assigned can be compensated using adjacent pixels. Furthermore, the cleaning time can be shortened and consumption of ink used in cleaning can be suppressed.

System Configuration in the Present Embodiment

FIG. 1 shows a system configuration of the present embodiment. A system is shown in which a printer 1 and a scanner 70 are connected to a computer 60.

Configuration of the Inkjet Printer

Figure 2:
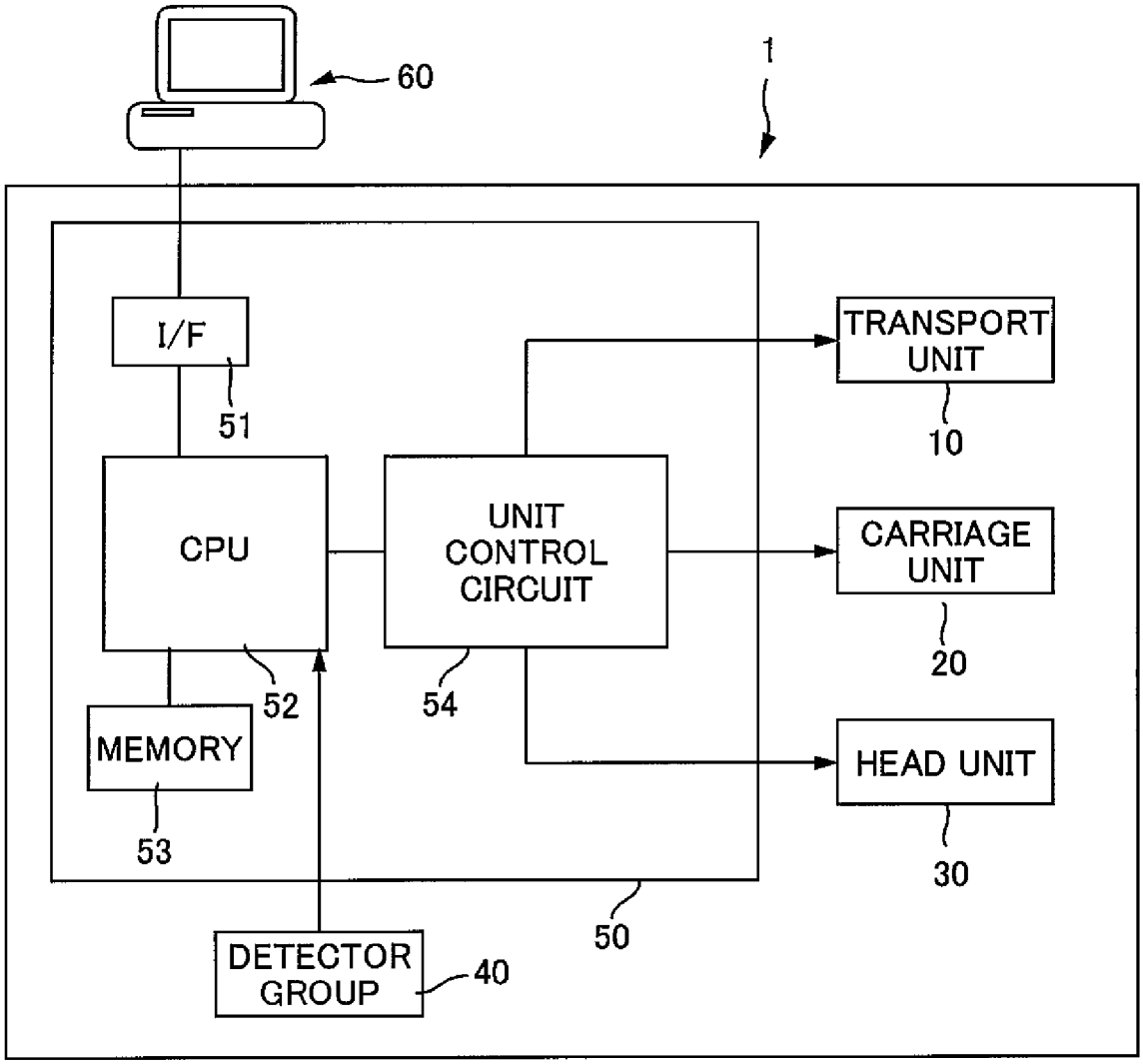
FIG. 2 is a block diagram of the overall configuration of a printer of this embodiment.
Figure 3A:
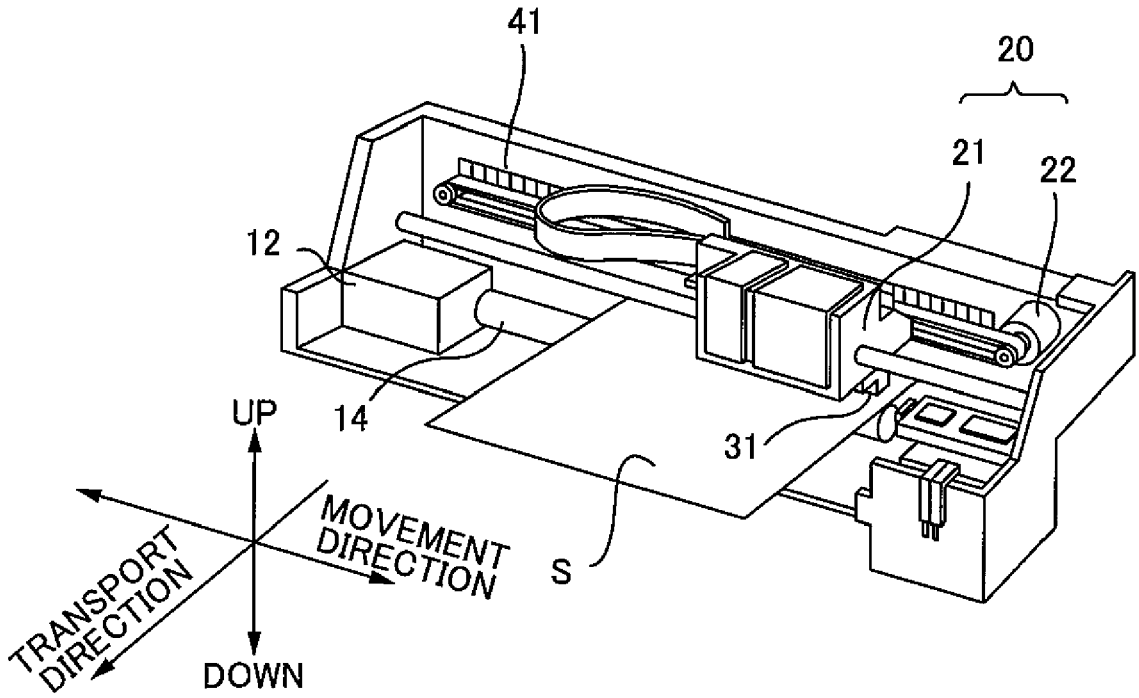
FIG. 3A is a schematic view of the overall configuration of the printer.
Figure 3B:
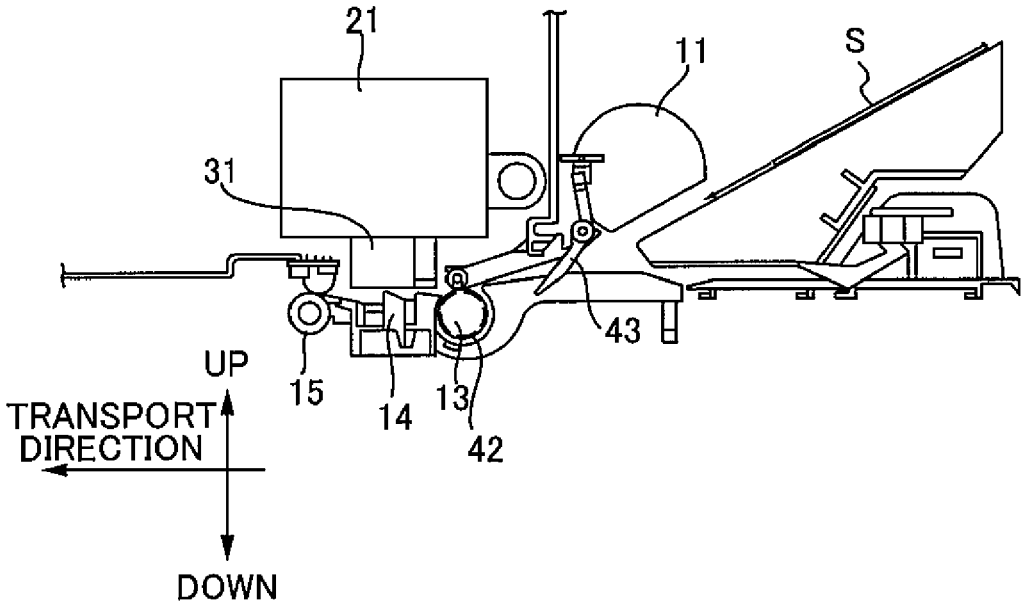
FIG. 3B is a cross-sectional view of the overall configuration of the printer.

FIG. 2 is a block diagram of the overall configuration of the printer 1. FIG. 3A is a schematic view of the overall configuration of the printer 1. FIG. 3B is a cross-sectional view of the overall configuration of the printer 1. The printer 1, upon having received print data from the computer 60, which is an external device, controls various units (a transport unit 10, a carriage unit 20, and a head unit 30) using a controller 50, and forms an image on a medium (hereinafter referred to as paper S). Furthermore, a detector group 40 monitors conditions inside the printer 1, and the controller 50 controls the various units based on the detection results.

The controller 50 is a control unit for performing control of the printer 1 and includes an interface section 51, a CPU 52, a memory 53, and a unit control circuit 54. The interface section 51 is for exchanging data between the computer 60, which is an external device, and the printer 1. The CPU 52 is an arithmetic processing device for carrying out overall control of the printer 1. The memory 53 is for ensuring a region for storing programs of the CPU 52 and a working region. The CPU 52 controls each unit using the unit control circuit 54 according to a program stored in the memory 53.

The transport unit 10 is for feeding the paper S to a printable position and, during printing, transporting the paper S by a predetermined transport amount in a transport direction (an intersecting direction), and is provided with a paper feed roller 11, a transport motor 12, a transport roller 13, a platen 14, a discharge roller 15.

The head unit 30 is for ejecting ink onto the paper S and includes a head 31. The head 31 has a plurality of nozzles serving as ink ejection sections. For driving each nozzle to eject ink, each nozzle is provided with a piezo element, which is a drive element, and an ink chamber containing ink (not shown).

The carriage unit 20 is for moving the head 31 in a movement direction (predetermined direction) and is provided with a carriage 21 and a carriage motor 22.

The detector group 40 includes a linear encoder 41, a rotary encoder 42, a paper detection sensor 43, and an optical sensor 44, for example.

Figure 4:
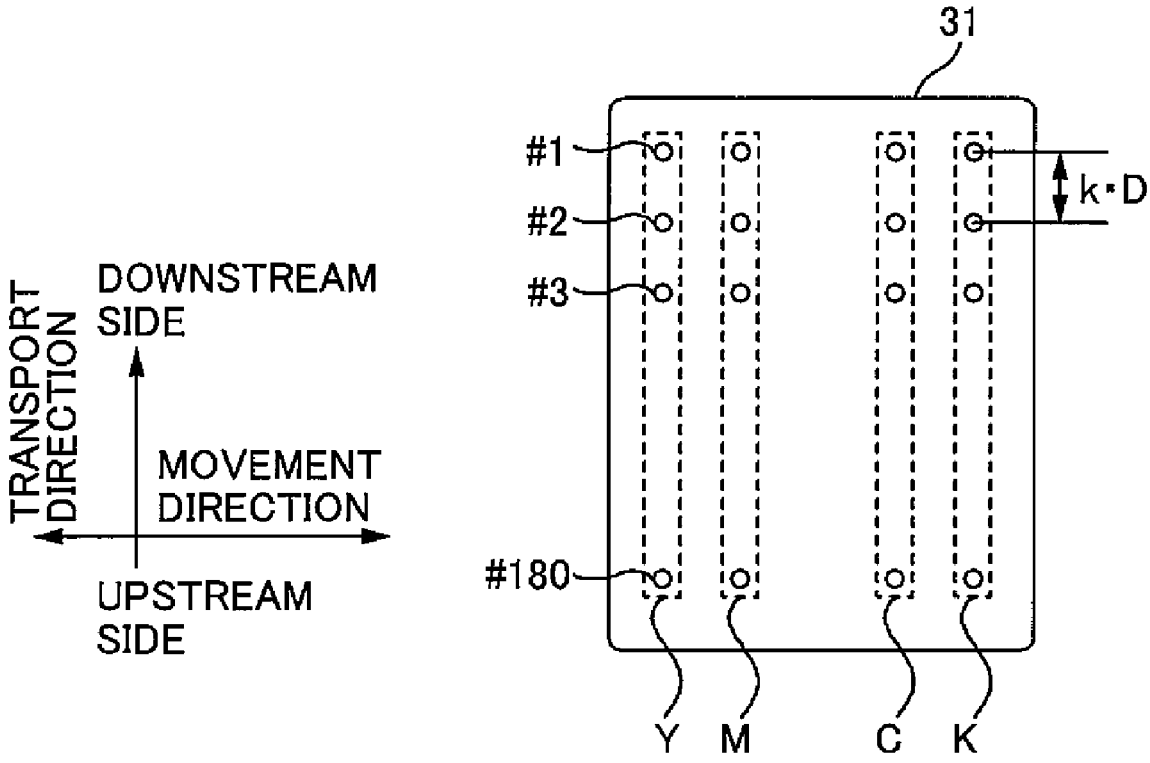
FIG. 4 is an explanatory diagram showing an arrangement of nozzles on a lower surface of a head.

FIG. 4 is an explanatory diagram showing an arrangement of the nozzles at a lower side (nozzle face) of the head 31. A yellow ink nozzle row Y, a black ink nozzle row K, a cyan ink nozzle row C, and a magenta ink nozzle row M are formed in the lower side of the head 31. Each nozzle row is provided with 180 nozzles that are ejection openings for ejecting inks of the respective colors. The 180 nozzles are each assigned a number (#i=#1 to #180) that becomes smaller the more downstream the nozzle. Furthermore, the nozzles of each nozzle row are arranged in a row at a constant spacing k·D along the transport direction.

Printing Procedure

Upon receiving a print command and print data from the computer 60, the controller 50 analyzes the content of the commands contained in the print data and carries out the following processes using the units.

First, the controller 50 rotates the paper feed roller 11 to feed the paper S to be printed on to the transport roller 13 (paper feeding process). When the paper detection sensor 43 detects a leading edge of the paper S that has been fed by the paper feed roller 11, the controller 50 rotates the transport roller 13 to position the paper S at a print commencement position (indexing position). When the paper S is positioned at the print commencement position, at least some of the nozzles of the head 31 are opposed to the paper S.

Next, the controller 50 drives the carriage motor 22 to move the carriage 21 in the movement direction. The head 31 is provided on the carriage 21 so that the head 31 and the carriage 21 both move together in the movement direction. Furthermore, a one-time movement of the carriage 21 in the movement direction is referred to as a pass. Then the controller 50 causes ink to be ejected from the nozzles in accordance with the print data while the carriage 21 is moving. Dots are formed on the paper S by ink droplets that have been ejected from the nozzles landing on the paper S (dot forming process). Since ink is intermittently ejected from the head 31 that is moving, rows of dots (raster lines) arranged along the movement direction are formed on the paper S.

Thereafter, the controller 50 drives the transport motor 12 to rotate the transport roller 13 and thereby transport the paper S by the predetermined transport amount in the transport direction (transport process). In this way, the head 31 can form dots in positions that are different from the positions of the dots formed by the preceding dot forming process.

Finally, the controller 50 determines whether or not to discharge the paper S undergoing printing (paper discharge process). If there is data remaining to be printed on the paper S undergoing printing, then paper discharge is not carried out and the dot forming process and the transport process are repeated alternately until there is no more data to be printed, thereby accomplishing an image. Then, when there is no more data to be printed on the paper S undergoing printing, the paper S is discharged by the rotation of the discharge roller 15.

Regarding the Print Data

Figure 5:
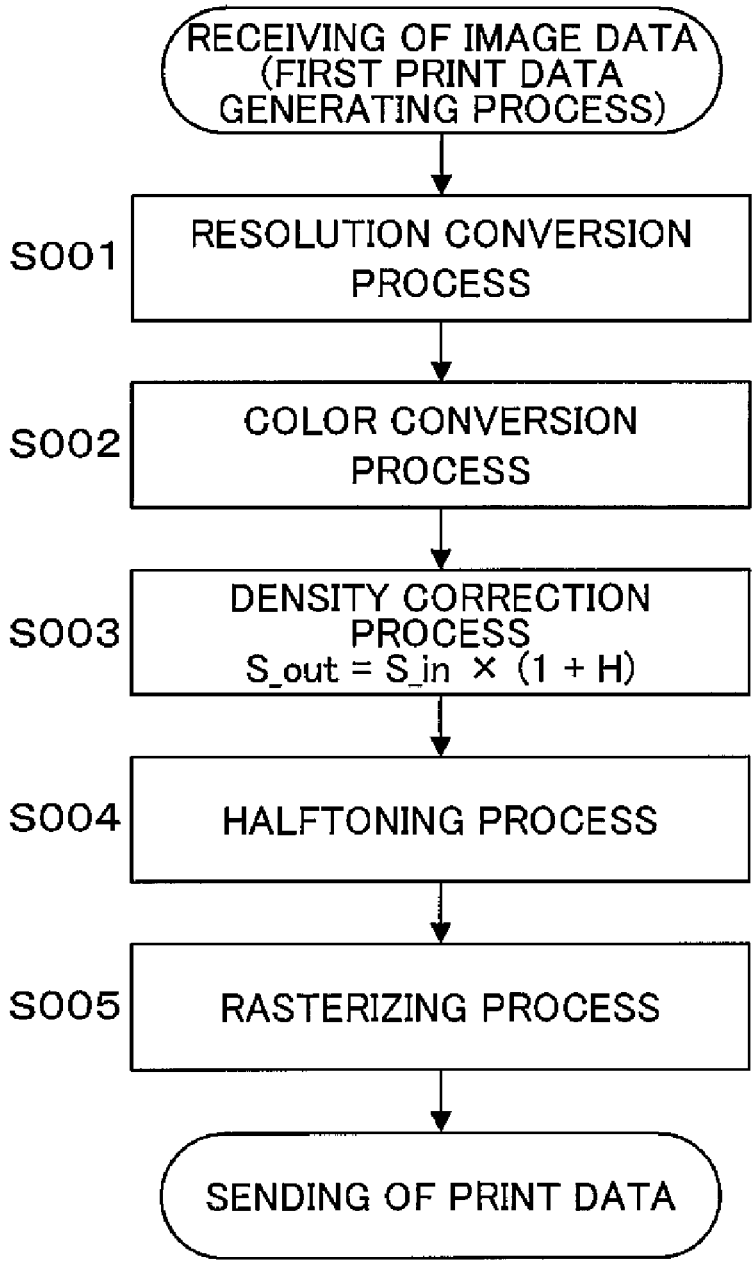
FIG. 5 is a flowchart of a print data generating process.

FIG. 5 is a flowchart of a print data generating process. The print data that is sent from the computer 60 to the printer 1 is generated in accordance with a printer driver stored in a memory of the computer 60. That is, the printer driver is a program for generating print data in the computer 60 and sending the print data to the printer 1.

A resolution conversion process (S001) is a process in which image data that has been outputted from an application program is converted to a resolution for printing on the paper S. When the resolution for printing on the paper S is specified as 720×720 dpi, then the image data received from the application program is converted to an image data of a resolution of 720×720 dpi. It should be noted that, after the resolution conversion process, the image data is data (RGB data) with 256 gradations expressed using an RGB color space.

Here, "image data" is a collection of data (pixel data) indicating pixels. And "pixels" are unit elements that constitute the image by specifying rectangular regions virtually defined on the paper S. An image is structured by lining up these pixels in a two dimensional manner. In the present embodiment, the image data is data having 256 gradations, and therefore single pixels are expressed in 256 gradations. That is, a single pixel is expressed by 8-bit data ($2^8$=256).

A color conversion process (S002) is a process in which RGB data is converted to CMYK data that is expressed using a CMYK color space corresponding to the inks of the printer 1. The color conversion process is performed by the printer driver referencing a table (not shown) in which tone values of RGB data are associated with tone values of CMYK data.

A density correction process (S003) is a process in which the tone values indicating the pixels are corrected, but this is described in detail later.

A halftoning process (S004) is a process in which data of a high number of gradations (256 gradations) is converted to data of a number of gradations that can be formed by the printer 1. In the present embodiment, the printer 1 can form three types of dots (large dots, medium dots, and small dots). For this reason, the printer 1 can express a single pixel with four patterns, namely "form a large dot," "form a medium dot," "form a small dot," and "form no dot." In other words, in the half toning process, data of 256 gradations is converted to data of four gradations.

A rasterizing process (S005) is a process in which image data in a matrix form is rearranged for each set of pixel data to an order in which it should be transferred to the printer 1. Print data that has been generated through these processes is transmitted by the printer driver to the printer 1 along with command data corresponding to a printing method (transport amounts and the like).

Scanner Configuration

Figure 6A:
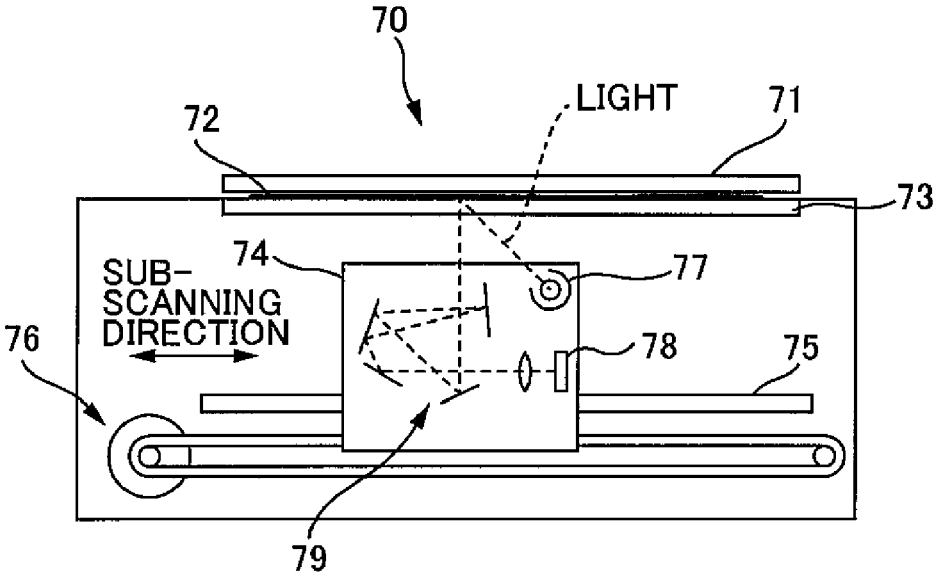
FIG. 6A is a vertical cross-sectional view of a scanner and FIG. 6B is a top view of the scanner with an upper cover removed.
Figure 6B:
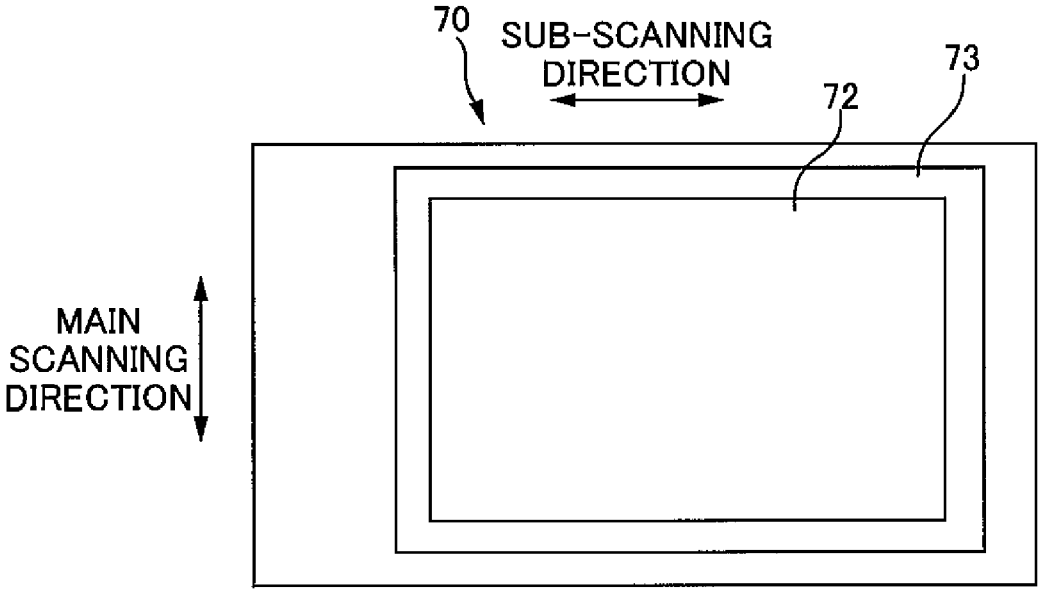

FIG. 6A is a vertical cross-sectional view of the scanner 70. FIG. 6B is a top view of the scanner 70 with an upper cover 71 removed. The scanner 70 is provided with the upper cover 71, an original table glass 73 on which an original 72 is placed, and a reading carriage 74 that moves in a sub-scanning direction while opposing the original 72 via the original table glass 73, a guiding member 75 that guides the reading carriage 74 in the sub-scanning direction, a movement mechanism 76 for moving the reading carriage 74, and a scanner controller (not shown) that controls each section in the scanner 70. The reading carriage 74 is provided with an exposure lamp 77 for irradiating the original 72 with light, a line sensor 78 that detects an image of a line in a main scanning direction, which is a direction perpendicular to the sub-scanning direction, and an optical system 79 for guiding light reflected by the original 72 to the line sensor 78. The dashed line in the reading carriage 74 of FIG. 6A indicates the light trajectory.

When reading an image of the original 72, an operator opens the upper cover 71 and places the original 72 on the original plate glass 73, and closes the upper cover 71. Then, the scanner controller causes the reading carriage 74 to move along the sub-scanning direction while causing the exposure lamp 77 to emit light, and reads the image on the surface of the original 72 with the line sensor 78. The scanner controller transmits the image data that has been read to the scanner driver of the computer 60, and in this way the computer 60 obtains the image data of the original 72.

Regarding Interlaced Printing

The printer 1 of the present embodiment performs an interlaced printing method. Here, "interlaced printing" refers to a printing method in which raster lines are recorded in one pass, and then raster lines are recorded sandwiched therebetween in another pass. In interlaced printing, the printing method for the start and end of printing is different from the printing in the middle, and therefore description is given separately for ordinary printing (printing of the middle) and leading edge/trailing edge printing.

Figure 7A:
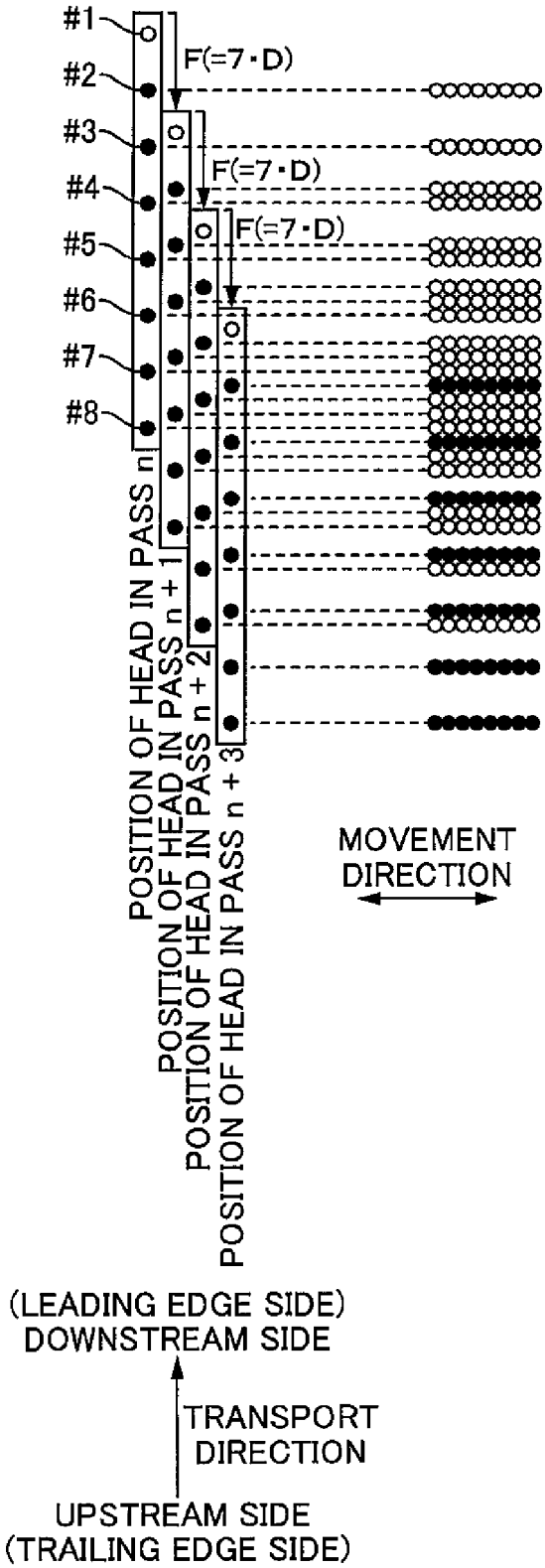
FIGS. 7A and 7B are explanatory diagrams of ordinary printing.
Figure 7B:
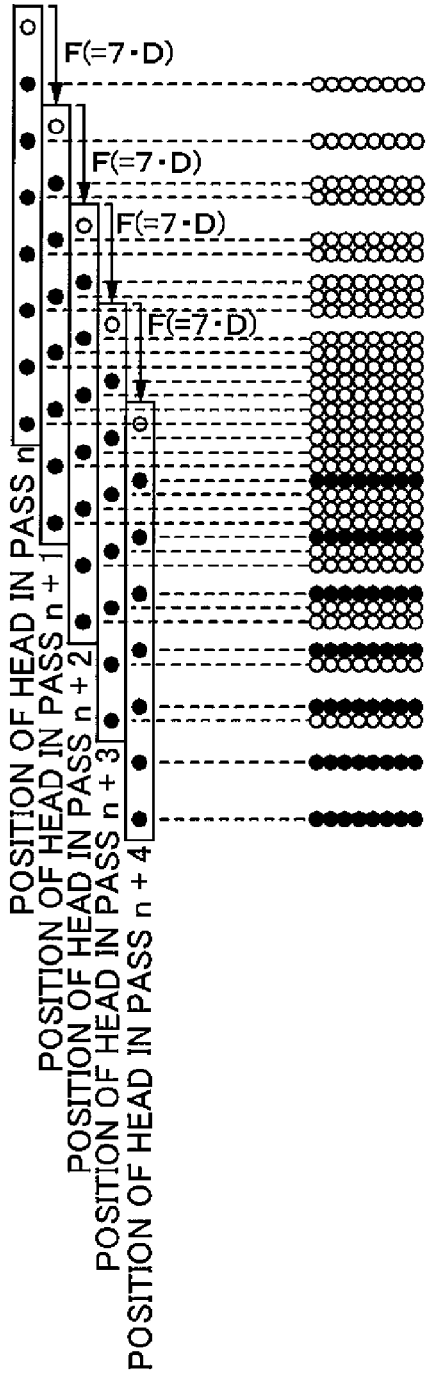

FIGS. 7A and 7B are explanatory diagrams of ordinary printing. FIG. 7A shows the positions of the head 31 and how dots are formed in passes n to n+3; and FIG. 7B shows the positions of the head 31 and how dots are formed in passes n to n+4. For convenience of description, only one nozzle row is shown, and the number of nozzles in the nozzle row is also reduced. Furthermore, the head 31 (the nozzle row) is illustrated as if moving with respect to the paper S, but FIG. 7 shows the relative position of the head 31 and the paper S, and in fact the paper S is moved in the transport direction. In FIGS. 7A and 7B, a nozzle represented by a black circle is a nozzle that can eject ink, while a nozzle represented by a white circle is a nozzle that cannot eject ink. Furthermore, in these diagrams, the dots indicated by solid circles are formed in the final pass, and the dots indicated by empty circles are formed in the passes prior to that.

With interlaced printing, every time the paper S is transported in the transport direction by a constant transport amount F, the nozzles record a raster line immediately above the raster line that was recorded in the immediately prior pass. To perform this recording operation while keeping the transport amount constant, it is necessary that (1) a number of nozzles N (integer) that can eject ink is prime with respect to k (k of nozzle spacing k·D), and (2) the transport amount F is set to N·D. Here, N=7, k=4, and F=7·D.

Figure 8:
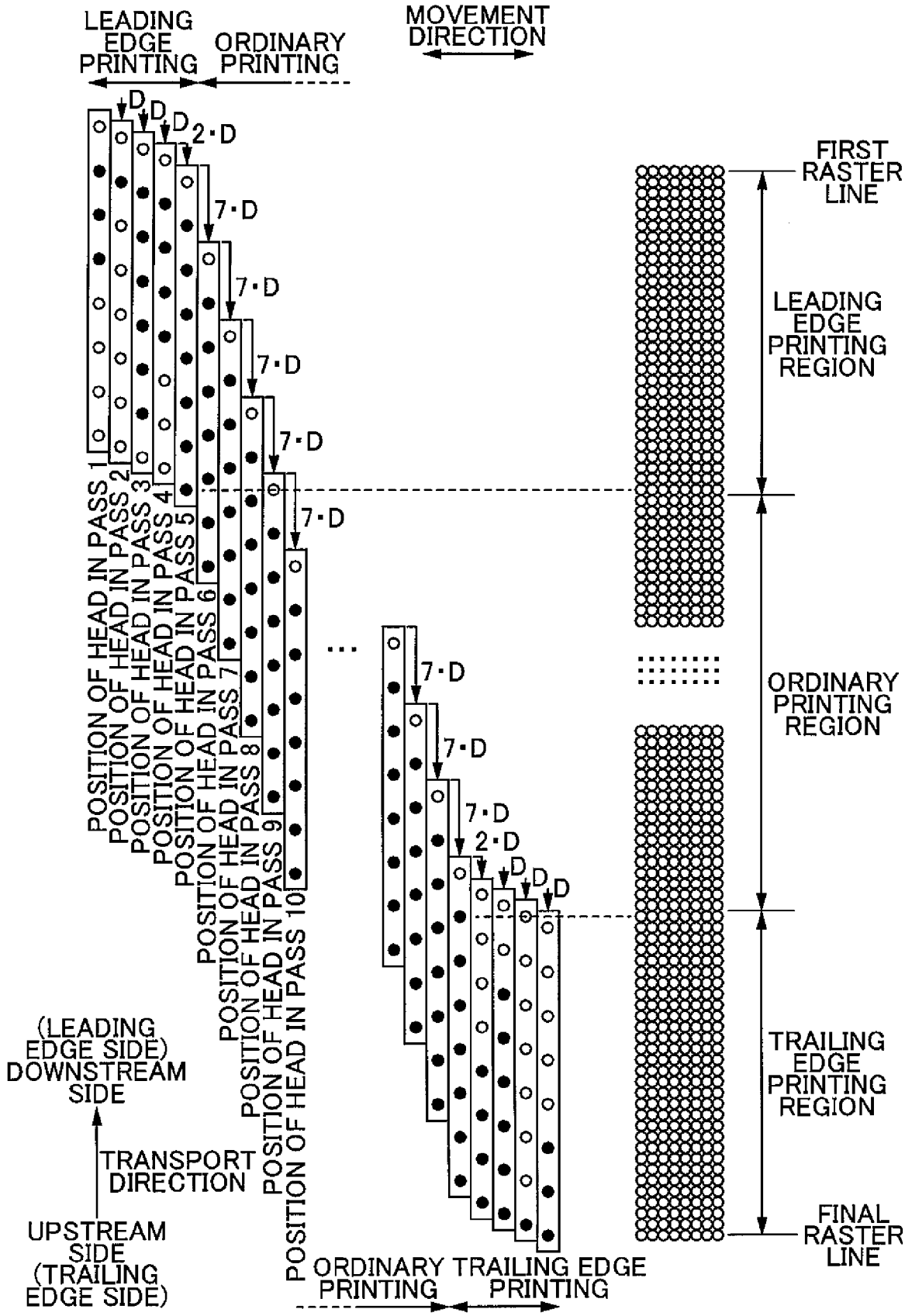
FIG. 8 is an explanatory diagram of leading edge printing and trailing edge printing.

FIG. 8 is an explanatory diagram of leading edge printing and trailing edge printing. The first five passes constitute the leading edge printing, and the last five passes constitute the trailing edge printing. In leading edge printing, the paper S is transported by a transport amount (1·D or 2·D) that is smaller than the transport amount (7·D) at the time of ordinary printing, and the nozzles that eject ink are not set. The trailing edge printing is performed in a same manner as the leading edge printing. Thus, 30 raster lines are formed in each of the leading edge printing and the trailing edge printing. In contrast to this, although it also depends on the size of the paper S, approximately several thousand raster lines are formed in ordinary printing.

It should be noted that there is a regularity in the manner raster lines are lined up in regions printed using ordinary printing (hereinafter referred to as "ordinary printing regions") in that a same number of raster lines is formed for each number of nozzles capable of ejecting ink (here, N=7 nozzles). In FIG. 8, the raster lines from the first raster line to be formed by ordinary printing until the 7th raster line are formed by the nozzles #3, #5, #7, #2, #4, #6, and #8 respectively, and the next seven raster lines from the 8th raster line onward are formed by the nozzles in the same order as this. On the other hand, compared to the raster lines of the ordinary printing regions, it is difficult to see regularity in the manner raster lines are lined up in regions printed using leading edge printing (hereinafter referred to as "leading edge printing regions") and regions printed using trailing edge printing (hereinafter referred to as "trailing edge printing regions").

Regarding Intrinsic Density Irregularities

"Row regions" are set for the following description. "Row region" refers to a region constituted by a plurality of pixels lined up in the movement direction. It should be noted in regard to pixel size that the size and shape are determined in response to the print resolution. For example, if the print resolution is 720 dpi (movement direction)×720 dpi (transport direction), the pixels are of a size of a square region of approximately 35.28 μm×35.28 μm(≈1/720 inch×1/720 inch).

Figure 9A:
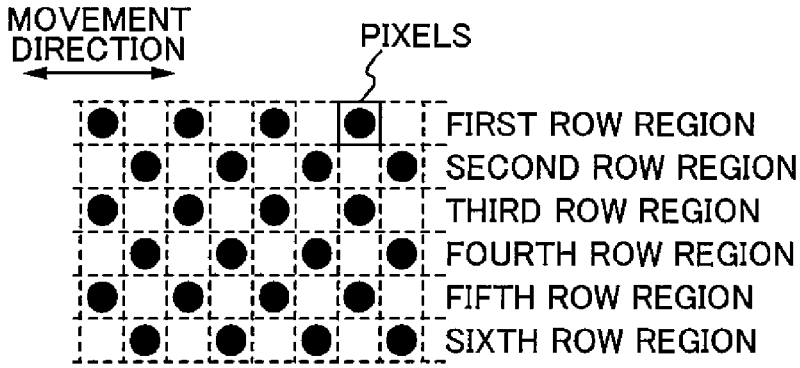
FIG. 9A shows dots formed in an ideal manner.

FIG. 9A shows dots formed in an ideal manner. Ideally formed dots refer to ink landing in the center position of the pixel such that the ink spreads on the paper S to form a dot on the pixel. Each dot correctly forming in each pixel means that the raster lines are correctly formed in row regions.

Figure 9B:
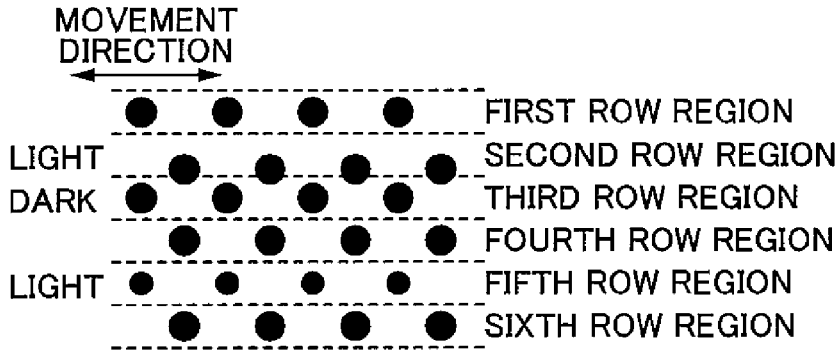
FIG. 9B shows an occurrence of intrinsic density irregularities.

FIG. 9B shows an occurrence of intrinsic density irregularities. "Intrinsic density irregularities" refers to density irregularities produced by ink not landing in a vertical direction or the ink ejection amount being incorrect due to problems such as the processing precision of the nozzles. That is, intrinsic density irregularities vary in location of occurrence and extent according to each printer.

For example, due to discrepancies in the flight direction of ink ejected from the nozzles, a raster line formed in a second row region is formed toward a third row region side. As a result, the second row region becomes lighter and the third row region becomes darker. Furthermore, the ink amount of the ink ejected toward a fifth row region is smaller than a prescribed ink amount, so that the dots formed in the fifth row region are smaller. As a result, the fifth row region becomes lighter.

When a printed image constituted by raster lines having shading variances in this manner is seen macroscopically, density irregularities in the form of stripes along the movement direction are visible. The quality of the printed image is reduced by these intrinsic density irregularities.

Method of Remedying Intrinsic Density Irregularities

Figure 9C:
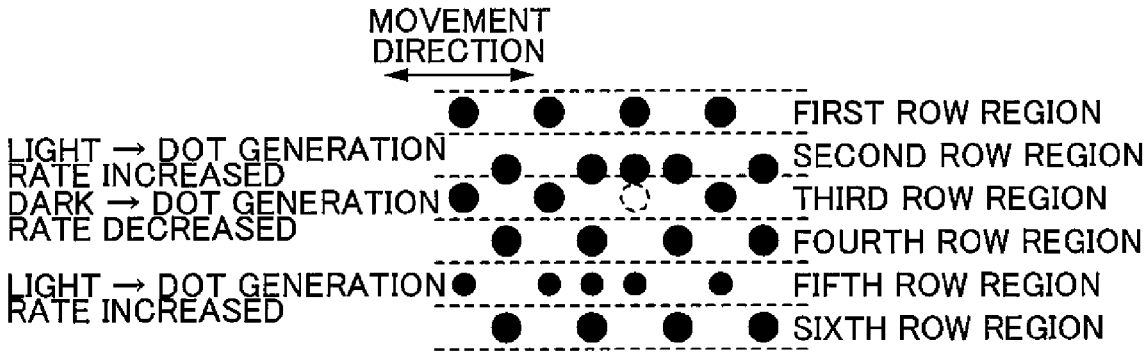
FIG. 9C shows a manner of remedying intrinsic density irregularities.

FIG. 9C shows a manner of remedying intrinsic density irregularities. In the present embodiment, with respect to a row region that tends to be recognized dark, the tone values of the pixels corresponding to that row region are corrected so that an image piece is formed lighter. Furthermore, with respect to a row region that tends to be recognized light, the tone values of the pixels corresponding to that row region are corrected so that an image piece is formed darker.

For example, in FIG. 9C, the tone values of the pixels corresponding to the row regions are corrected so that the dot generation rates of the second and fifth row regions, which are recognized as light, become higher, and the dot generation rate of the third row region, which is recognized as dark, becomes lower. As a result, the dot generation rates of the raster lines in these row regions are modified, the densities of the image pieces of these row regions are corrected, and density irregularities in the printed image overall are suppressed.

Incidentally, in FIG. 9B, the density of the image piece formed in the third row region becomes darker not because of the effect of the nozzle that forms the raster line in the third row region, but because of the effect of the nozzle that forms the raster line in the adjacent second row region. For this reason, if the nozzle that forms the raster line in the third row region forms a raster line in another row region, the density of that row region does not necessarily become darker. In other words, even with image pieces that are formed by the same nozzle, if nozzles that form image pieces adjacent to those image pieces are different, the density of those image pieces may be different. In such a case, it is impossible to suppress the density irregularities by merely setting correction values in association with the nozzles. Accordingly, in the present embodiment, the tone values of the pixels are corrected based on correction values H that are set for each row region. It should be noted that in the present embodiment, higher tone values indicate pixels having darker tone values and lower tone values indicate pixels having lighter tone values.

Regarding Correction Values H For Intrinsic Density Irregularities

Figure 10:
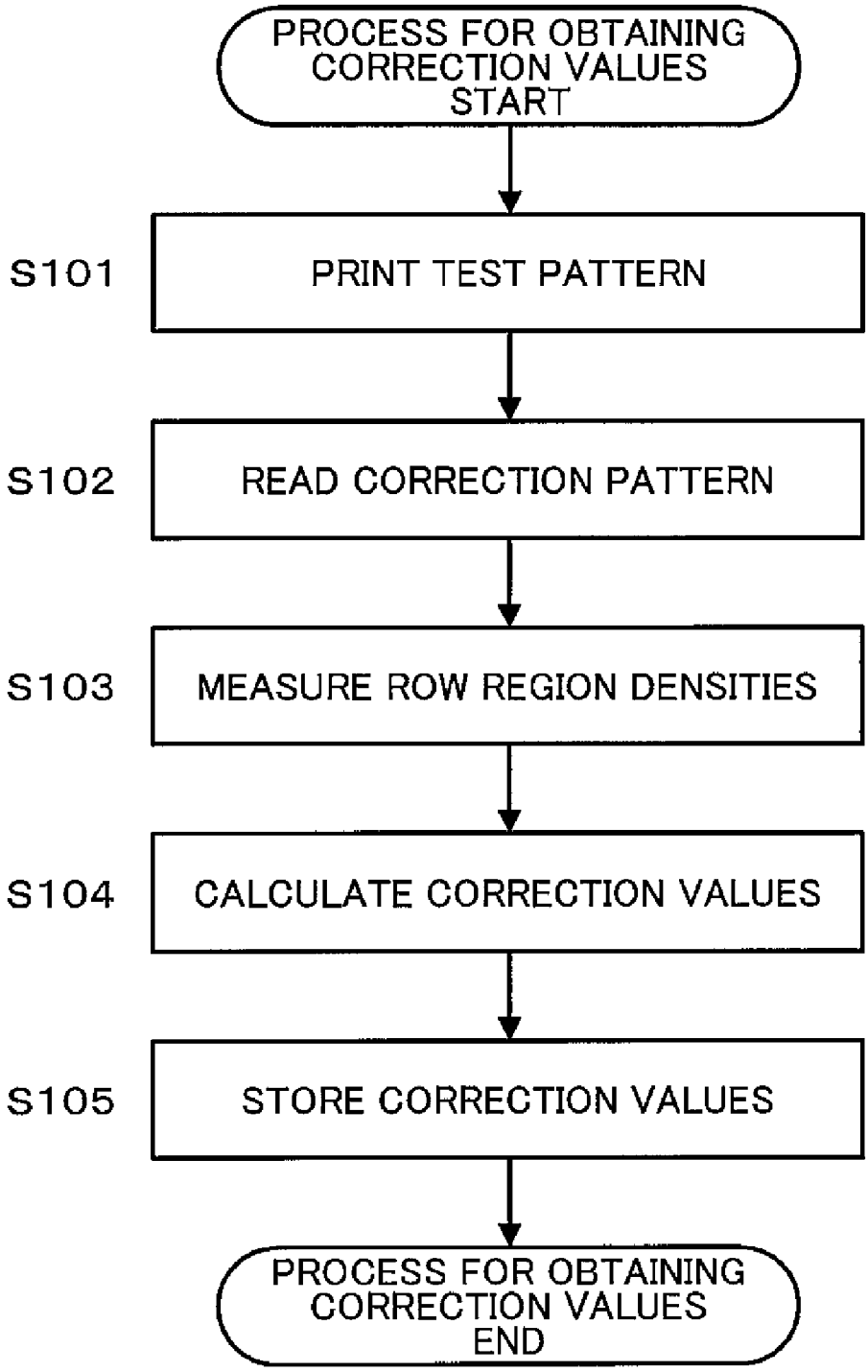
FIG. 10 is a flowchart of a process for obtaining correction values that is performed in a testing process after the printer is manufactured.

FIG. 10 is a flowchart of a process for obtaining correction values that is performed in a testing process after the printer is manufactured. The correction values H for intrinsic density irregularities are values specific to each printer since they relate to problems such as the processing precision of the nozzles. For this reason, the correction values H are calculated for each printer in a testing process at the printer manufacturing factory.

For the purpose of testing, the printer 1 to be tested for intrinsic density irregularities and the scanner 70 are connected to the computer 60 as shown in FIG. 1. A printer driver for causing the printer 1 to print the test pattern, a scanner driver for controlling the scanner 70, and a program for obtaining correction values for carrying out image processing or analyzing or the like with respect to image data of the test pattern that is read from the scanner 70 are installed on the computer 60 in advance.

S101: Generating a Test Pattern

Figure 11A:
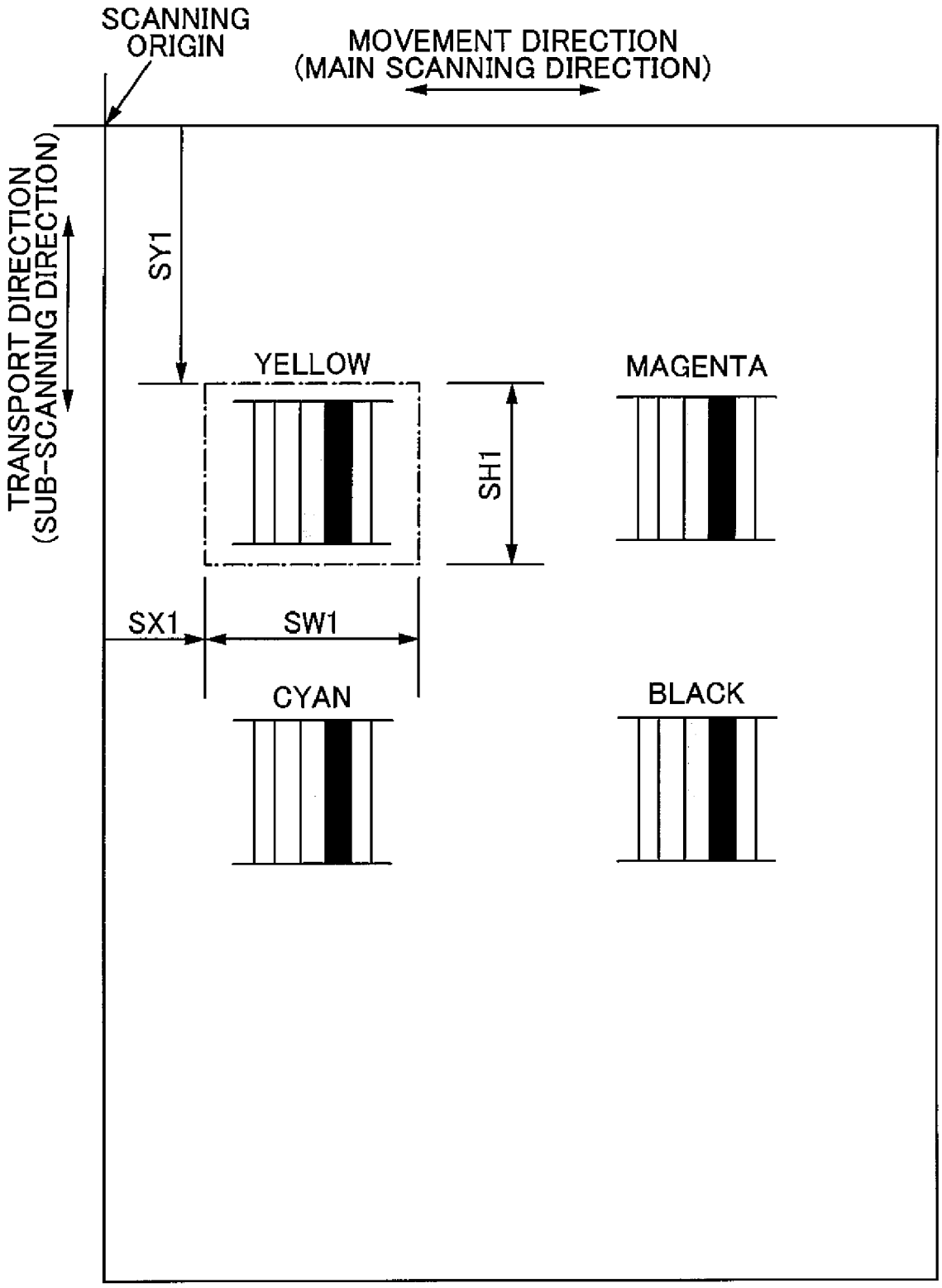
FIG. 11A is an explanatory diagram of a test pattern.
Figure 11B:
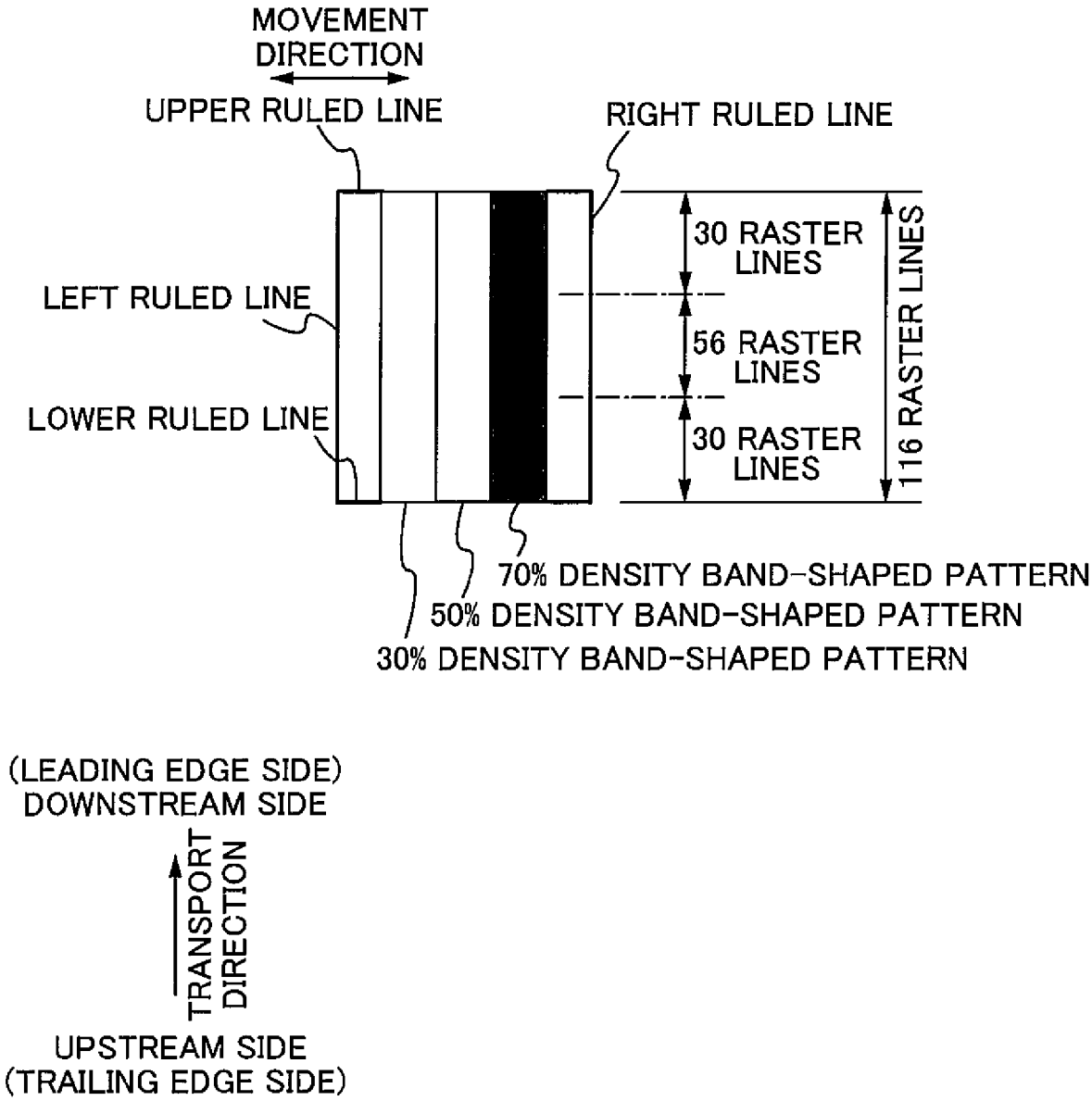
FIG. 11B is an explanatory diagram of a correction pattern.

First, the printer driver of the computer 60 causes the printer 1 to print a test pattern. FIG. 11A is an explanatory diagram of a test pattern. FIG. 11B is an explanatory diagram of a correction pattern. Four correction patterns are formed as the test pattern for the separate colors (for separate nozzles). Each correction pattern is constituted by band-shaped patterns in three density levels, an upper ruled line, a lower ruled line, a left ruled line, and a right ruled line. Each band-shaped pattern is generated based on image data of a constant tone value, and the band-shaped patterns are constituted by, from the left band-shaped pattern in order, a tone value 76 (30% density), a tone value 128 (50% density), and a tone value 179 (70% density), with the density increasing in this order. For example, the 30% density band-shaped pattern is constituted by pixels of the tone value 76. It should be noted that these three tone values are set as an "instructed tone value", and respectively expressed as Sa(=76), Sb(=128), and Sc(=179).

Then, each band-shaped pattern is formed using leading edge printing, ordinary printing, and trailing edge printing. Accordingly, these are constituted by 30 leading edge printing region raster lines, 56 ordinary printing region raster lines, and 30 trailing edge printing region raster lines. Although several thousands of raster lines are formed in the ordinary printing region during ordinary printing, raster lines of eight periods (7×8 periods) are formed in the ordinary printing region when printing correction patterns. The upper ruled line is formed by the first raster line from the leading edge side constituting the band-shaped pattern and the lower ruled line is formed by the 116th raster line from the leading edge side.

S102: Reading the Correction Patterns

Next, the test pattern that has been printed is read by the scanner 70. A scanning origin at the upper left of the image of the test pattern that has been read is set as a reference and a reading range is specified. As shown in FIG. 11A, a range of a dashed dotted line surrounding the correction pattern formed by the yellow ink nozzle row is set as the reading range of the correction pattern formed by the yellow ink nozzle row. It should be noted that parameters SX1, SY1, SW1 and SH1 are preset in the scanner driver by the program for obtaining correction values. A range larger than the correction pattern is set as the reading range so that no problem is presented even when the original is set slightly misplaced in the scanner 70. The reading ranges of the correction patterns formed by the other nozzle rows are similarly specified.

S103: Measuring the Density of the Row Regions

Next, the program for obtaining correction values calculates measurement values of each row region in the three band-shaped patterns. That is, it calculates tone values (read tone values) of each pixel row (a plurality of pixels lined up in an x direction) corresponding to each row region.

Figure 12A:
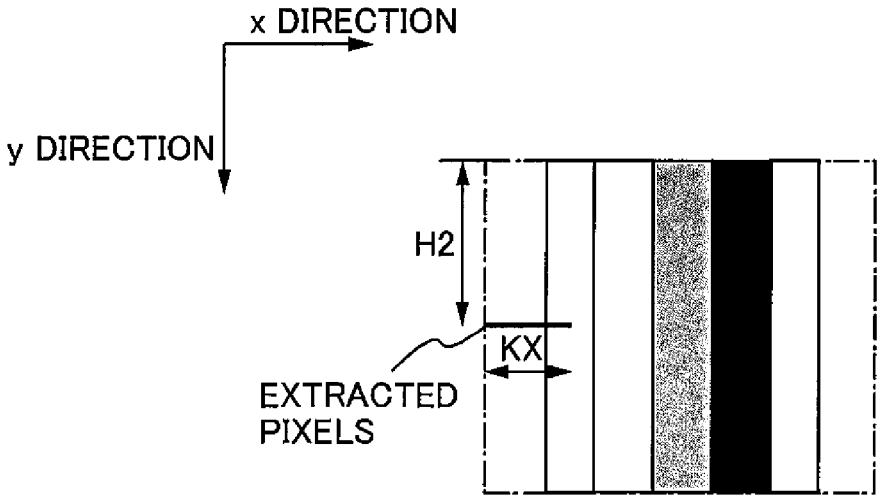
FIG. 12A is an explanatory diagram of the image data in detecting the left ruled line.

FIG. 12A is an explanatory diagram of the image data in detecting the left ruled line. From the image data that has undergone resolution conversion, the program for obtaining correction values takes out pixel data of pixels that are H2 pixels from the top and a KX number of pixels from the left. At this time, the parameter KX is predetermined so that the pixel data taken out includes the left ruled line. Then, the program for obtaining correction values determines a centroid position of the left ruled line from the pixel data of the KX number of pixels that have been extracted.

Figure 12B:
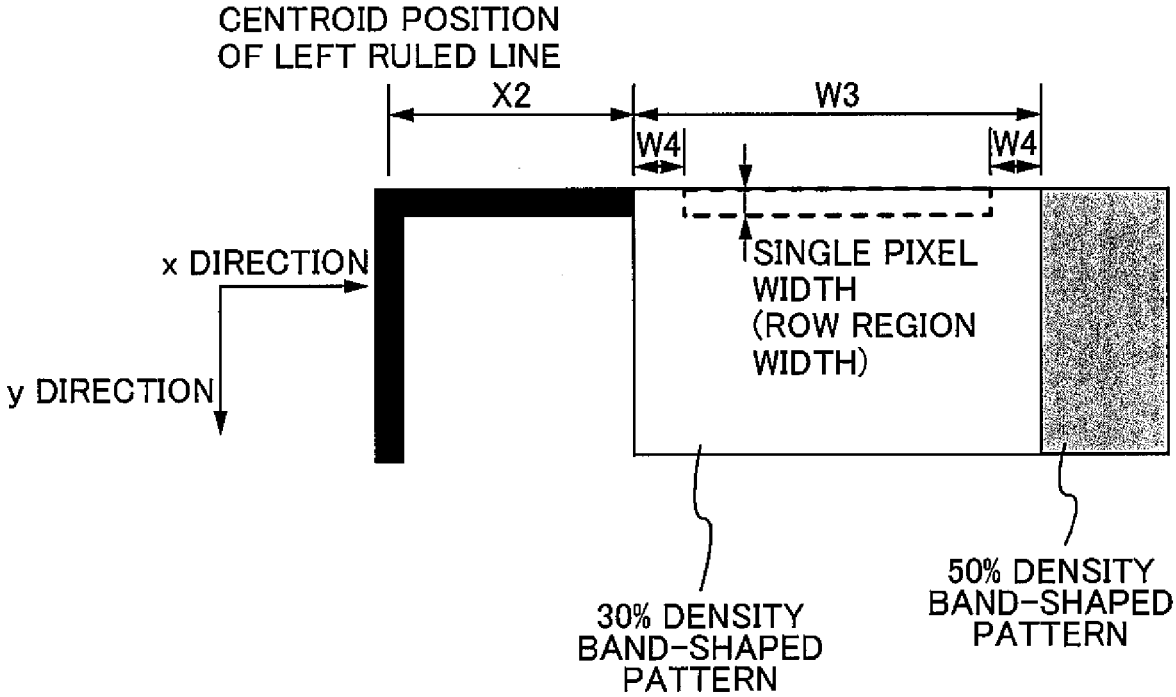
FIG. 12B is an explanatory diagram of a measuring range for the density of the 30% density band-shaped pattern in the first row region.

FIG. 12B is an explanatory diagram of a measuring range for the density of the 30% density band-shaped pattern in the first row region. It is already known from the form of the correction pattern that the 30% density band-shaped pattern with a width W3 is present on the right side of the centroid position of the left ruled line by a distance X2. Accordingly, the program for obtaining correction values extracts for each row region pixel data of a range of shown by the dashed line excluding a W4 range on the left and right in the 30% density band-shaped pattern. An average value of the tone values of the extracted pixel data is the measurement value of 30% density for each row region. In this manner, the program for obtaining correction values measures the densities of the three band-shaped patterns for each row region.

Figures 13, 14:
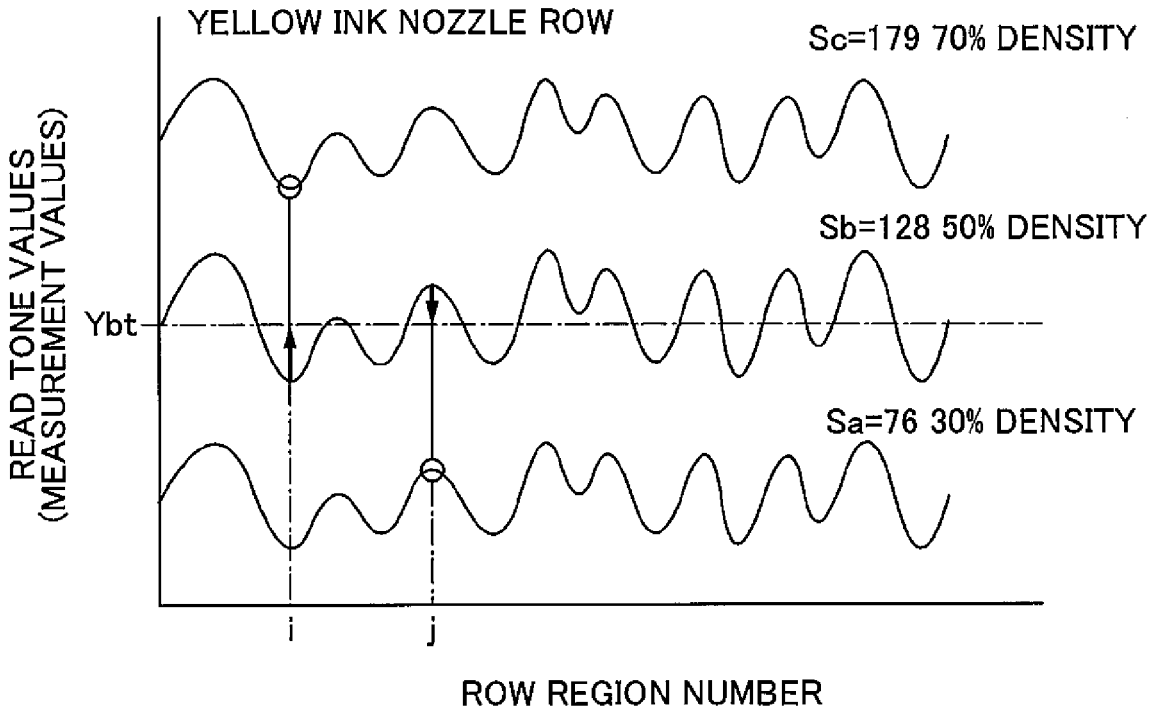
FIG. 13 is a measurement value table summarizing measurement results of the densities of the three band-shaped patterns formed by the yellow ink nozzle row.
FIG. 14 is a graph of measurement values in the band-shaped patterns of instructed tone values Sa, Sb, and Sc of the yellow nozzle row.

FIG. 13 is a measurement value table summarizing measurement results of the densities of the three band-shaped patterns formed by the yellow ink nozzle row. As shown in FIG. 13, the program for obtaining correction values associates the measurement values of the densities of the three band-shaped patterns with each row region to create the measurement value table. It should be noted that FIG. 13 shows an n number of measurement values for an instructed tone value Sa(=76) of the yellow nozzle row as measurement value Ya_n, an n number of measurement values for an instructed tone value Sb(=128) as measurement value Yb_n, and an n number of measurement values for an instructed tone value Sc(=179) as measurement value Yc_n. Furthermore, a measurement value table is created for each nozzle row (YMCK).

FIG. 14 is a graph of measurement values in the band-shaped patterns of the instructed tone values Sa, Sb, and Sc of the yellow nozzle row. The horizontal axis indicates the row region number and the vertical axis indicates the measurement value. Even though the row regions were formed uniformly with each of the instructed tone values, unevenness occurs in the measurement values depending on the row region. This unevenness is the difference in density in each row region and is a cause of intrinsic density irregularities in printed images.

To remedy these intrinsic density irregularities, it is necessary to eliminate unevenness in the measurement values of each row region having same tone values. That is, the intrinsic density irregularities are remedied by bringing the measurement values of each row region closer to constant values. Accordingly, in the present embodiment, an averaged value of measurement values of all the row regions having a same tone value is set as a target value and the instructed tone value is corrected so that the measurement value of each row region approaches the target value.

For example, an average value of measurement values (Yb_1 to Yb_116) of all the row regions in the 50% density band-shaped pattern is set as a target value Ybt of the yellow ink nozzle row. Then, in a row region i having a measurement value lower than the target value Ybt, the tone values are corrected so that printing is performed darker than the setting of the instructed tone value Sb. On the other hand, in a row region j having a measurement value higher than the target value Ybt, the tone values are corrected so that printing is performed lighter than the setting of the instructed tone value Sb. Furthermore, the corrected tone values are set as target instructed tone values Sbt.

S104: Calculating the Correction Values

In order to describe a method of calculating the correction values, description is given using as examples the row region i and the row region j of the 50% density (Sb=128) band-shaped pattern formed by the yellow ink nozzle row. It is assumed that the measurement value of the row region i is lower than the target value Ybt and that the measurement value of the row region j is higher than the target value Vbt.

Figure 15A:
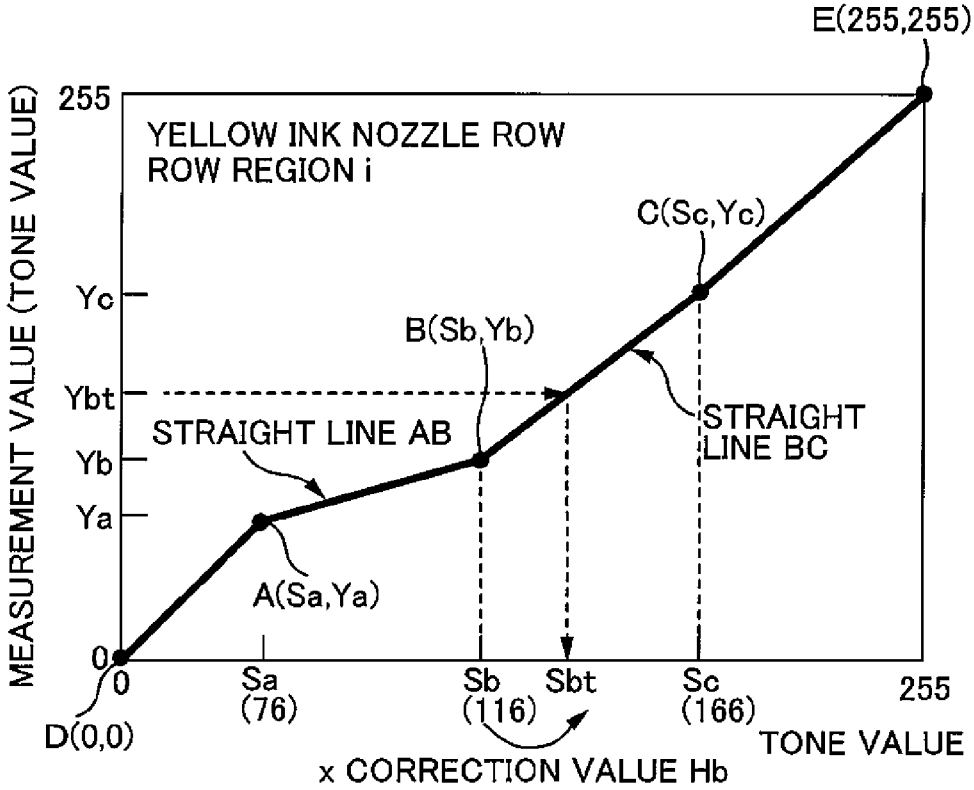
FIG. 15A is an explanatory diagram of the target instructed tone value Sbt for the instructed tone value Sb in the row region i.

FIG. 15A is an explanatory diagram of the target instructed tone value Sbt for the instructed tone value Sb in the row region i. The printer driver instructs printing to be performed based on the target instructed tone value Sbt so that the density of the row region i becomes the target value Ybt. The target tone value Sbt is calculated by the following formula (linear interpolation based on a straight line BC).

$$Sbt=Sb+(Sc-Sb)\times\{(Ybt-Yb)/(Yc-Yb)\}$$

Figure 15B:
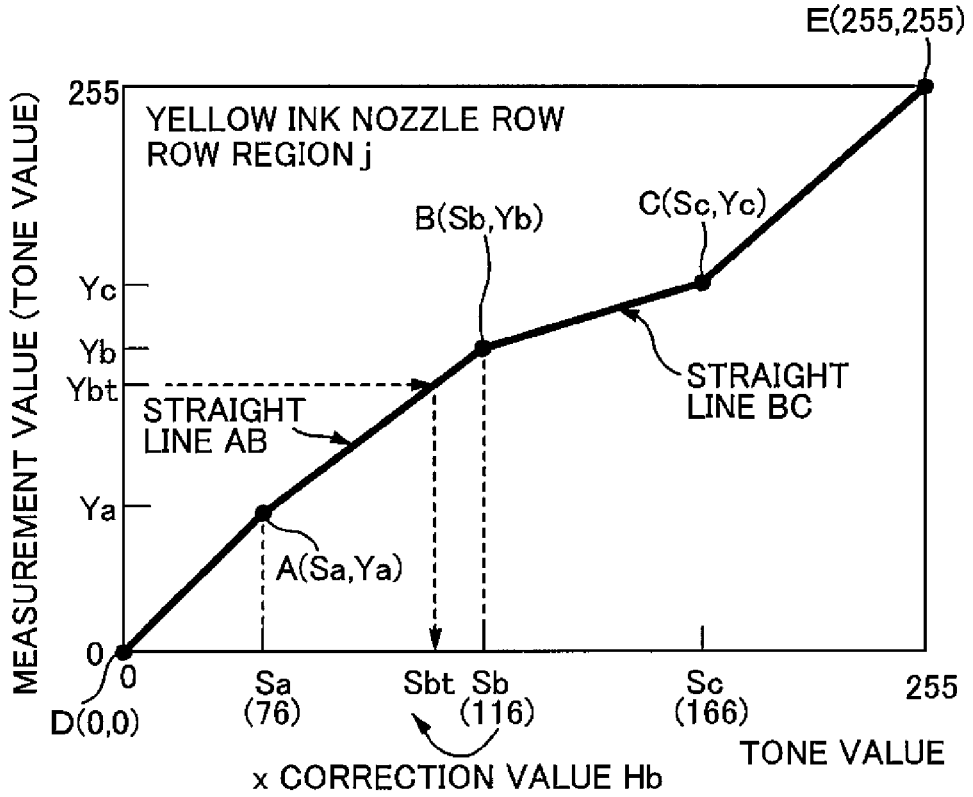
FIG. 15B is an explanatory diagram of the target instructed tone value Sbt for the instructed tone value Sb in the row region j.

FIG. 15B is an explanatory diagram of the target instructed tone value Sbt for the instructed tone value Sb in the row region j. The printer driver instructs printing to be performed based on the target instructed tone value Sbt so that the density of the row region j becomes the target value Ybt. The target tone value Sbt is calculated by the following formula (linear interpolation based on a straight line AB).

$$Sbt=Sb-(Sb-Sa)\times\{(Ybt-Yb)/(Ya-Yb)\}$$

Next, the program for obtaining correction values calculates a correction value Hb for the instructed tone value Sb in these row regions using the target instructed tone values Sbt. It should be noted that the correction value Hb is calculated for each row region.

$$Hb=(Sbt-Sb)/Sb$$

Furthermore, the program for obtaining correction values calculates correction values (Ha and Hc) for other instructed tone values (Sa and Sc) by setting the measurement value for the lowest tone value (=0) to 0 (a point D) and the measurement value for the highest tone value 255 to 255 (a point E). The correction value Ha for the instructed tone value Sa is calculated for each row region based on the point D (0, 0) and a point A and a point B (linear interpolation based on a straight line DA or a straight line AB). Then, the correction value Hc for the instructed tone value Sc is calculated based on the point B and a point C and the point E (255, 255) (linear interpolation based on a straight line BC or a straight line CE). Then the three correction values (Ha, Hb, and Hc/a first correction value) are calculated for each row region for all the ink nozzle rows.

Incidentally, 56 raster lines are printed in the ordinary region of the correction pattern. However, correction values are not calculated for each of the 56 row regions, but rather seven correction values are calculated based on an average of the measurement values of the densities in every eighth row region between seven row regions. Since there is regularity for every seven raster lines in the ordinary region, correction values of these seven raster lines are used based on the regularity. For example, for the measurement value Yb of the first row region of the ordinary printing region in the 50% density band-shaped pattern of yellow, an average value is used of the measurement values of the eight row regions in the ordinary printing region, these being the 1st, 8th, 15th, 22nd, 29th, 36th, 43rd, and 50th row regions. Similarly, average values of the eight row regions are used also for the measurement values (Ya and Ye) of the other densities. Then, based on the measurement values that have been averaged, the correction values (Ha, Hb, and He) of the first row region in the ordinary region are calculated.

S105: Storing the Correction Values

FIG. 16 is an explanatory diagram of a correction value table for the yellow ink nozzle row. Next, the program for obtaining correction values stores the correction values in the memory 53 of the printer 1. There are three types of correction value tables, these being for leading edge printing, ordinary printing, and trailing edge printing. In the correction value table for each nozzle row, the three correction values (Ha, Hb, and Hc) are associated with each nozzle row. For example, three correction values (Ha_n, Hb_n, and Hc_n) are associated with an n-th raster line in the row regions. The correction value tables for the nozzle rows are stored in the memory 53.

The process for obtaining correction values ends when correction values have been stored in the memory 53 of the printer 1. Then a CD-ROM on which the printer driver is stored is packaged with the printer 1 and the printer 1 is shipped from the factory.

Regarding a User-based Process for Correcting Intrinsic Density Irregularities

A user who has purchased the printer 1 connects the printer 1 to a computer in the possession of that user. Then the user places the CD-ROM that was packaged with the printer in a recording/reproducing device 90 and installs the printer driver.

Having been installed on the computer 60, the printer driver requests the printer 1 to send to the computer 60 the correction values H for the intrinsic density irregularities stored in the memory 53. In response to the request, the printer I sends the correction value tables of intrinsic density irregularities to the computer 60. The printer driver stores the correction values H that have been sent from the printer 1 in a memory inside the computer 60. In this way, image data created on the computer 60 can be printed on the printer 1.

Then, upon receiving a print command from the user, the printer driver generates print data and transmits the print data to the printer 1. The printer 1 carries out print processing according to the print data. It should be noted that the method for generating print data is as described earlier (FIG. 5).

Hereinafter, detailed description is given regarding a density correction process with respect to intrinsic density irregularities. In this density correction process, the tone value indicated by each pixel is corrected based on the correction value H corresponding to the row region pertaining to that pixel.

Suppose that a tone value S_in indicated by a certain pixel prior to correction is equivalent to one of the instructed tone values (Sa, Sb, and Sc). In this case, the correction values Ha, Hb, and Hc stored in the memory of the computer 60 can be used as they are for the tone value S_in prior to correction. For example, if the tone value S_in prior to correction=Sc, then a tone value S_out after correction is obtained by the following formula.

$$S_out = Sc \times (1 + Hc)$$

Figure 17:
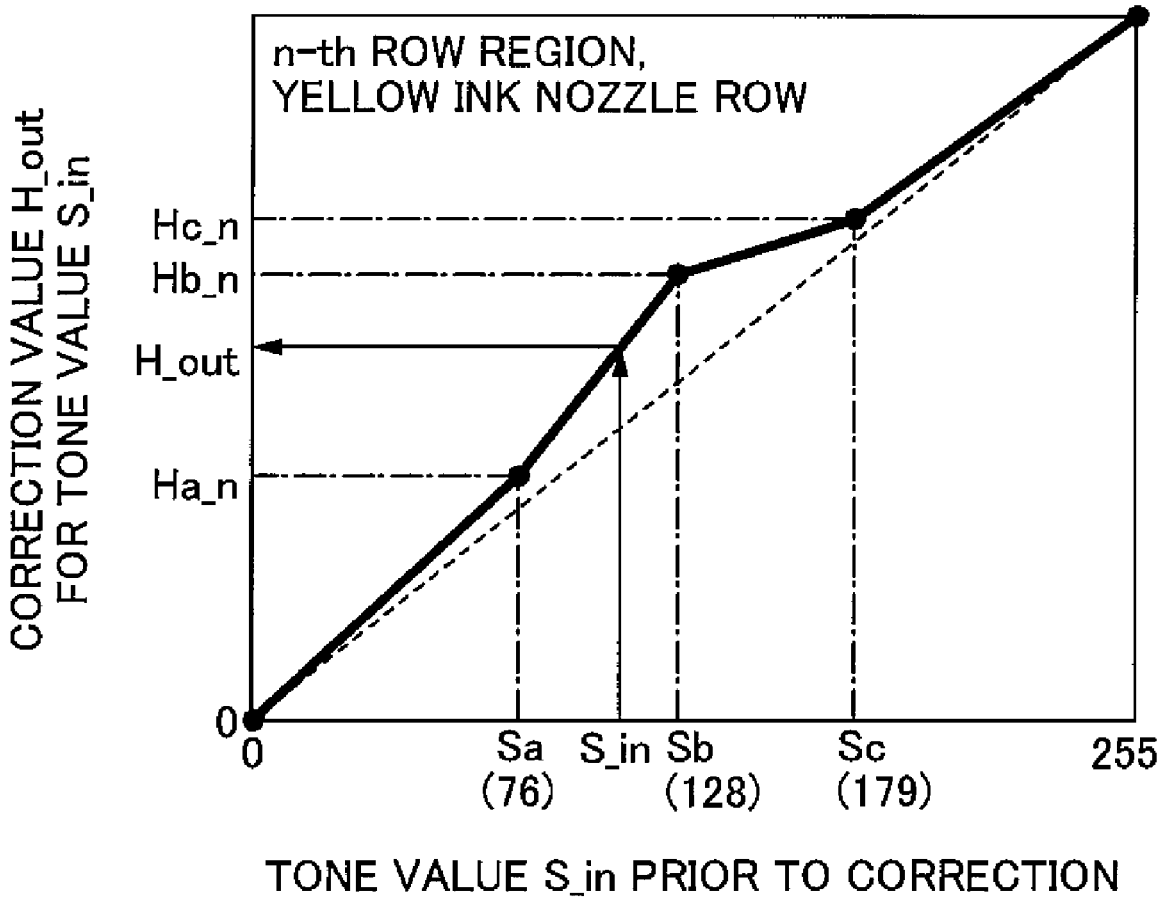
FIG. 17 illustrates a density correction process when a tone value prior to correction is different from the instructed tone value.

FIG. 17 illustrates a density correction process when a tone value prior to correction is different from the instructed tone value. The horizontal axis shows the tone values S_in prior to correction and the vertical axis shows the correction values H_out associated with the tone values S_in. The correction value H_out for the tone value S_in indicating a certain pixel prior to correction is calculated by the following formula using linear interpolation based on the correction value Ha_n of the instructed tone value Sa and the correction value Hb_n of the instructed tone value Sb.

$$H_out = Ha_n + (Hb_n - Ha_{13}n) \times \{(S_in - Sa)/(Sb - Sa)\}$$

Then, the tone value S_in prior to correction is corrected based on the calculated correction value H_out.

$$S_out = S_in \times (1 + H_out)$$

The printer driver carries out the density correction process on the tone values of pixels pertaining to the first to 30th row regions of leading edge printing based on the correction value H corresponding to the first to 30th row region stored in the correction value table for leading edge printing. Similarly, for trailing edge printing, the printer driver carries out the density correction process on the tone values of pixels pertaining to the first to 30th row regions of trailing edge printing based on the correction value H corresponding to the first to 30th row region stored in the correction value table for trailing edge printing.

For ordinary printing, since there is regularity in each set of seven row regions, the printer driver carries out the density correction process for each set of seven row regions of the approximately several thousand row regions repetitively using seven correction values H in order. In this way, the data amount of correction values H to be stored can be reduced. And the printer driver similarly carries out the density correction process not only for the yellow ink nozzle row, but also for the tone values of the pixel data of the other nozzle rows.

Due to density correction processing, correction is performed on the row regions that tend to be recognized dark such that the tone values of the pixel data of the pixels corresponding with that row region become lower. Conversely, the correction is performed on the row regions that tend to be recognized light such that the tone values of the pixel data of the pixels corresponding with that row region become higher. In other words, as shown in FIG. 9C, for a row region that tends to be recognized dark, the tone values of the pixel data of that row region are corrected to become lower, and therefore the dot generation rate of dots that constitute the raster line in that row region becomes lower. Conversely, for a row region that tends to be recognized light, the dot generation rate becomes higher. And this remedies the intrinsic density irregularities in the printed image overall.

Intrinsic density irregularities produced by problems such as the processing precision of the nozzles are remedied by the above-described method. However, when a faulty nozzle occurs while the printer is being used by the user, density irregularities (non-ejection density irregularities) different from intrinsic density irregularities occur undesirably. Hereinafter, detailed description is given regarding non-ejection density irregularities due to faulty nozzles.

Regarding Non-Ejection Density Irregularities

"Non-ejection density irregularities" refers to density irregularities produced by faulty nozzles that do not eject ink when ink should be ejected. Faulty nozzles occur in such ways as ink thickeners or foreign substances such as paper dust adhering in the nozzle such that the nozzle becomes blocked, and by air bubbles entering the ink chamber (cavity) of the head. When a faulty nozzle occurs, no dot is formed in the pixel where a dot should be formed, and therefore differences in shading occur due to pixels in which dots are formed correctly and pixels in which dots are not formed due to a faulty nozzle, density irregularities occurs, and image quality is reduced.

Figure 18A:
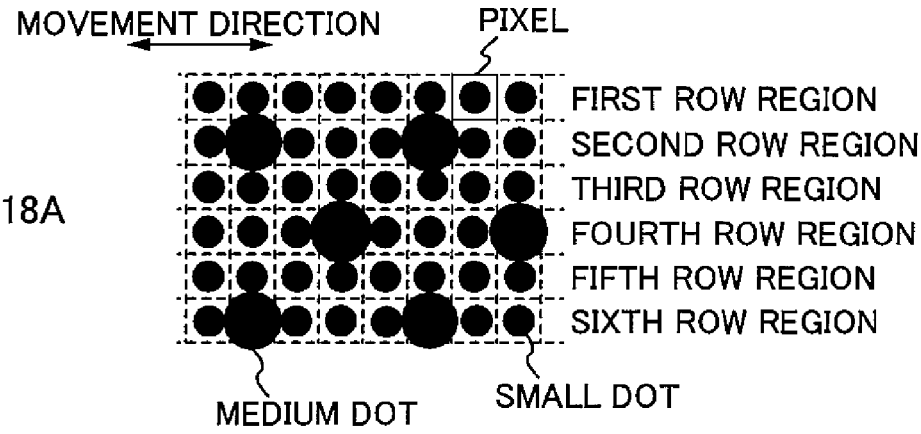
FIG. 18A shows dots formed in an ideal manner using interlaced printing.
Figure 18B:
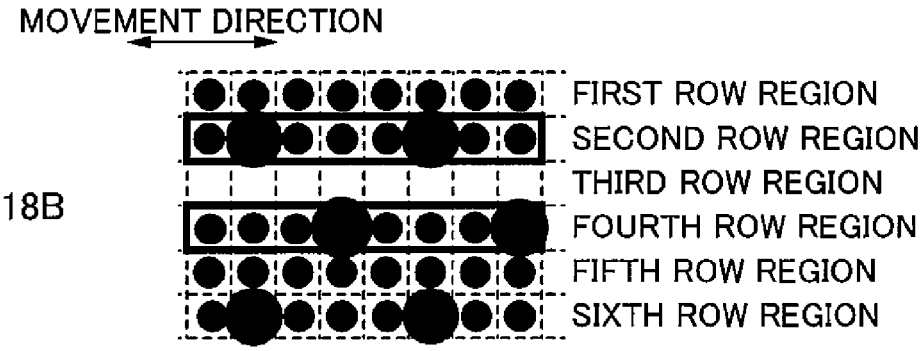
FIG. 18B shows dots not formed in a third row region due to a faulty nozzle.

FIG. 18A shows dots formed in an ideal manner using interlaced printing. FIG. 18B shows dots not formed in a third row region due to a faulty nozzle. It should be noted that it is assumed in these diagrams that dots are to be formed in all pixels. With interlaced printing, a single raster line is formed by a single nozzle. Thus, in a case where a nozzle that has been assigned to form dots in the third row region is faulty, undesirably no dots at all will be formed in the third row region. As a result, the third row region will appear undesirably in the image as a streak. That is, the shading difference between the row region to which the faulty nozzle has been assigned and other row regions will result in density irregularities (non-ejection density irregularities), and image quality of the printed image will be reduced.

Regarding Testing for Faulty Nozzles

Figure 19A:
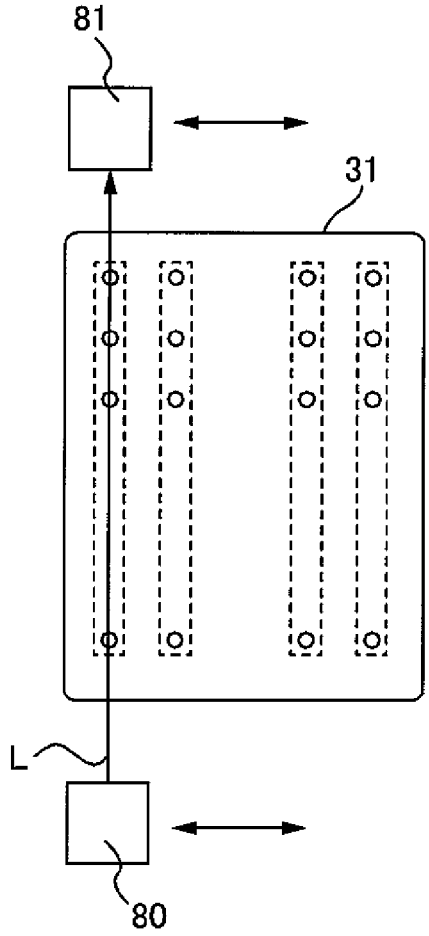
FIG. 19A shows a head and a testing section as viewed from below.

Incidentally, if no faulty nozzle occurs, non-ejection density irregularities are not produced. Accordingly, next description is given concerning testing for faulty nozzles in which a check is conducted as to whether or not a faulty nozzle has occurred. FIG. 19A shows the head 31 and a testing section as viewed from below. The testing section is constituted by a laser source 80, a laser receiving element 81, and a mechanism (not shown) for moving the laser source 80 and the laser receiving element 81 in the movement direction.

The laser source 80 irradiates a laser light L parallel to the nozzle row. The laser source 80 and the laser receiving element 81 are arranged so that the trajectory of ink ejected normally from each nozzle intersects the laser light L. Then, when a predetermined amount of ink is ejected in a vertical direction from a nozzle toward the paper S, the laser light L is blocked by the ink. Conversely, when ink has not been ejected from the nozzle, the laser light L is not blocked.

Figure 19B:
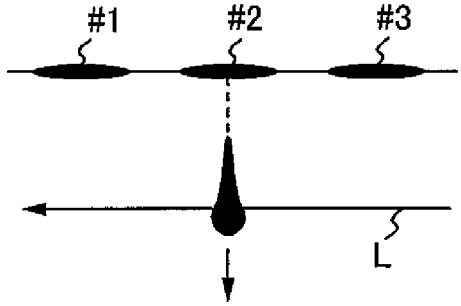
FIG. 19B shows how ink is ejected normally from a nozzle.

FIG. 19B shows how ink is ejected normally from a nozzle. In the diagram, the predetermined amount of ink is being ejected from a nozzle #2 in a vertical direction toward the paper S. When this happens, the ejected ink transverses the laser light L midway. As a result, the laser receiving element 81 receives an amount of light that is at or below a threshold (or light reception is temporarily disrupted) and a determination is made that the nozzle #2 is a normal nozzle. It should be noted that this threshold is a value established in advance according to an amount of light by which the predetermined amount of ink blocks the laser light L.

Figure 19C:
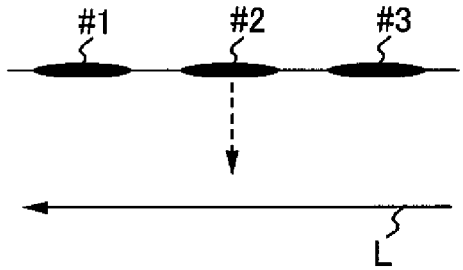
FIG. 19C shows how ink is not ejected from a nozzle.

On the other hand, FIG. 19C shows how ink is not ejected from the nozzle #2. In a case where ink has not been ejected from the nozzle #2 even though an attempt has been made to eject ink from the nozzle #2, the laser light L is not blocked by ink. As a result, the laser receiving element 81 always receives the laser light L and a determination is made that the nozzle #2 is a faulty nozzle.

Figure 20:
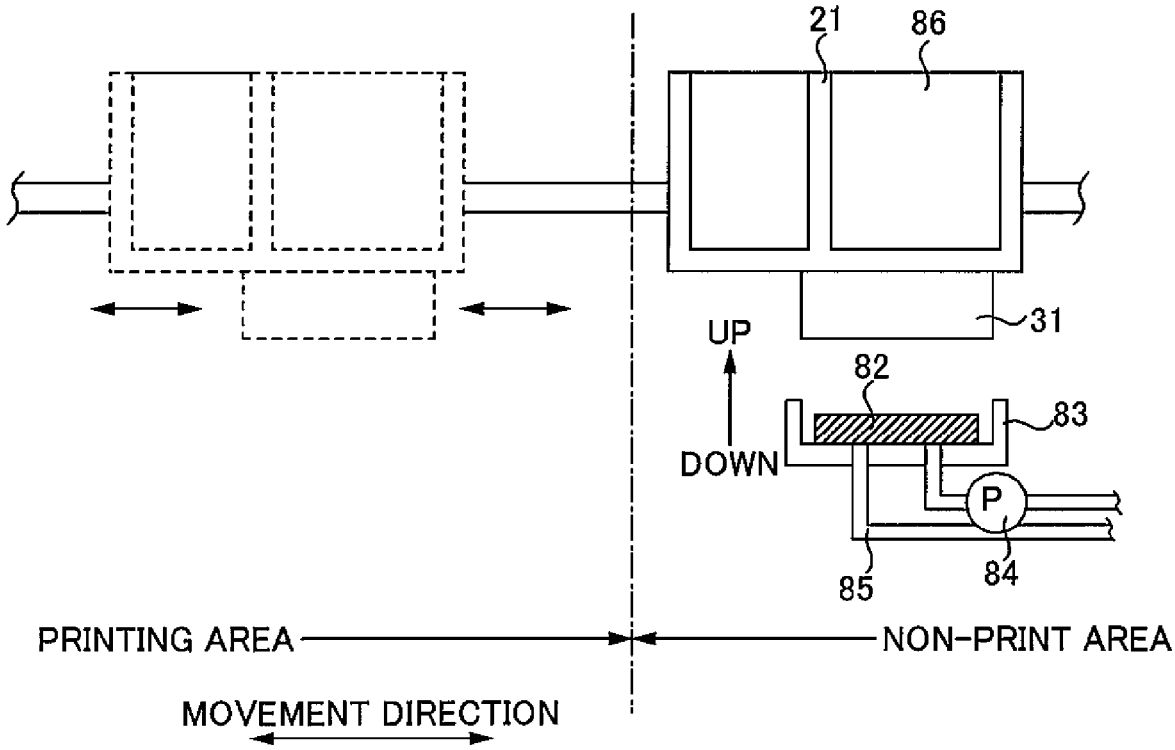
FIG. 20 shows head positions when testing for a faulty nozzle.

FIG. 20 shows head positions when testing for a faulty nozzle. Since ink is ejected from the nozzles during faulty nozzle testing, a pump suction device is necessary. The pump suction device is constituted by an ink absorber 82, a cap 83, a pump 84, a tube 85, and a mechanism (not shown) for moving the pump suction device up and down. The pump suction device is arranged in a non-print area and cannot move in the movement direction. For this reason, during cleaning, the head 31 moves directly over the pump suction device in the non-print area. "Non-print area" refers to an area outside the printing area, which is where ink is ejected from the nozzles in order to print on the paper S. That is, in faulty nozzle testing, ink is ejected from a nozzle toward the cap in the non-print area, and therefore there is no smearing of the paper S or the transport roller 13.

In this way, by carrying out faulty nozzle testing, it is possible to perform a check as to whether or not a faulty nozzle has occurred. If no faulty nozzle has occurred, then there will be no non-ejection density irregularities. However, if printing is executed without implementing a remedying measure even though a faulty nozzle has occurred, then non-ejection density irregularities will occur undesirably. Next, description is given regarding a remedying method for non-ejection density irregularities when a faulty nozzle has occurred.

Remedying Method for Non-ejection Density Irregularities 1: Cleaning

Cleaning the nozzle face of the head 31 (recovery process) can be put forth as one remedying method for non-ejection density irregularities according to the present embodiment. By cleaning the nozzle face, a faulty nozzle is recovered and ink can be ejected normally. Flushing and pump suction are carried out as cleaning. It should be noted that the head 31 is moved to the non-print area when cleaning is carried out. Then, the pump suction device is moved upward so that the cap 83 contacts the lower surface of the head 31.

Flushing, which is one method of cleaning, is a cleaning operation in which ink is forcefully ejected from the nozzles. Even when the nozzle is blocked and ink stops being ejected, a meniscus of the nozzle (a free surface of the ink exposed at the nozzle) is driven by expanding or contracting the ink chamber. As a result, in the cases such as where thickening of the ink in the ink chamber has not advanced too far, the blockage of the nozzle is eliminated and ink is ejected normally.

Furthermore, pump suctioning refers to a cleaning operation in which a pump is driven and ink inside the ink chamber is forcefully suctioned. One end of the tube 85, which is an ink discharge path, connects to a bottom surface inside the cap 83, and another end is connected to a waste ink cartridge (not shown) via the tube pump. The ink absorber 82 is arranged at a bottom surface inside the cap 83, and not only the waste ink sucked out by the pump 84, but also waste ink due to faulty nozzle testing and flushing is absorbed and waste ink is discharged to the waste ink cartridge via the tube 85.

With these cleaning operations, foreign substances on the nozzle surface can be expelled together with the ink, the meniscus on the nozzle that has dried due to thickening can be returned to a normal condition, and air bubbles inside the ink chambers (cavities) of the head 31 can be eliminated. In this manner, ink is ejected normally from the faulty nozzles.

That is, by carrying out cleaning of the head 31, ink is ejected normally from the faulty nozzles and non-ejection density irregularities are reliably remedied. Note however that a certain amount of time is required when carrying out cleaning and that the printing time becomes undesirably longer. Moreover, ink is consumed undesirably in order to carry out cleaning.

Remedying Method for Non-ejection Density Irregularities 2: Correcting Tone Values of Adjacent Pixels Next, description is given regarding a method of remedying non-ejection density irregularities without carrying out cleaning. In other words, this is a method in which printing is carried out while a condition in which ink is not ejected from a faulty nozzle remains as it is, but non-ejection density irregularity is remedied.

With the present embodiment, in a case where cleaning is not carried out even though a faulty nozzle has occurred, the tone value of a pixel that is adjacent to a pixel to which the faulty nozzle is assigned to form a dot (hereinafter referred to as an adjacent pixel), is corrected. Furthermore, the tone value of the adjacent pixel is corrected to become higher. By setting the tone value of the adjacent pixel higher, the pixel to which the faulty nozzle is assigned is corrected. Note however that the nozzle assigned to the adjacent pixel has to be functioning normally. This is because if the nozzle assigned to the adjacent pixel is also a faulty nozzle, then setting the tone value of the adjacent pixel higher will not remedy the non-ejection density irregularities (a specific correction method is described later).

Figure 18C:
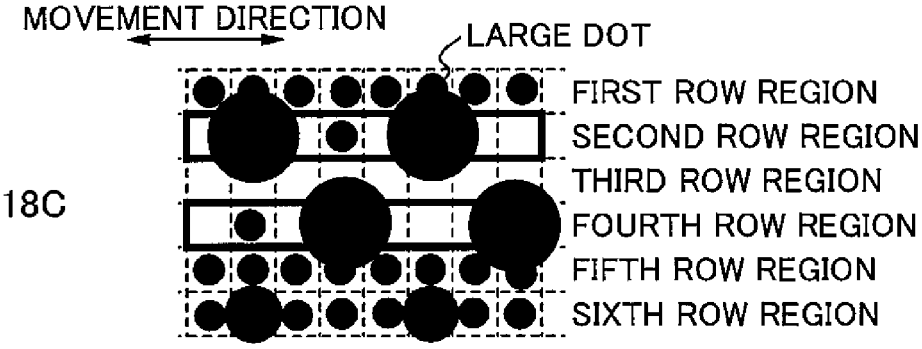
FIG. 18C shows a state in which tone values of adjacent pixels are corrected in interlaced printing.

FIG. 18C shows a state in which tone values of adjacent pixels are corrected in interlaced printing. With interlaced printing, a single raster line is formed by a single nozzle. That is, in the diagram, the nozzle assigned to form a dot in the pixels pertaining to the third row region is the same faulty nozzle. For this reason, non-ejection density irregularities will not be remedied by correcting the correction values of pixels that are adjacent in the movement direction to pixels in the third row region (other pixels in the third row region).

Furthermore, with interlaced printing, a particular raster line and a raster line neighboring it in the transport direction are formed by respectively different nozzles. For example, suppose that a single faulty nozzle is detected during faulty nozzle testing. If the nozzle that has been assigned to form dots in the third row region in FIG. 18C is faulty, then the nozzles assigned to form dots in the second and fourth row regions will be normal nozzles. That is, the pixels pertaining to the second and fourth row regions are "pixels adjacent to pixels onto which liquid should be ejected from the faulty nozzle." Accordingly, by correcting the tone values of the pixels pertaining to the second and fourth row regions, non-ejection density irregularities are remedied.

In FIG. 18B prior to remedying, medium dots and small dots are formed in the second and fourth row regions. In contrast to this, in FIG. 18C after remedying, the tone values of the second and fourth row regions are corrected so as to become higher, such that large dots are formed in the second and fourth row regions. By increasing the tone values of the pixels pertaining to the second and fourth row regions in this manner, the densities (tone values) of the third row region in which dots are not formed are compensated.

That is, in a case where a single raster line is formed by a single nozzle as in interlaced printing, non-ejection density irregularity is remedied by correcting the tone values of pixels (adjacent pixels) pertaining to two row regions adjacent in the transport direction to the row region to which a faulty nozzle had been assigned to form dots.

Regarding Correction Amount R for Non-Ejection Density Irregularities

Next, description is given regarding a correction amount R for correcting the tone values of pixels that are adjacent to pixels to which a faulty nozzle has been assigned (adjacent pixels). Intrinsic density irregularities produced by problems such as the processing precision of the nozzles are density irregularities specific to each printer. In contrast to this, non-ejection density irregularities are produced by dots not being formed, and therefore there is almost no printer-dependent difference. For this reason, although the correction values H for intrinsic density irregularities are calculated separately in a testing process at the printer manufacturing factory, the correction values R for non-ejection density irregularities are calculated for each printer model during a design phase. The calculated correction values R are used commonly among printers of the same model.

Next, description is given regarding a method of calculating the correction values R. In order to calculate the correction values R, the printer 1 to be tested for non-ejection density irregularities and the scanner 70 are connected to the computer 60 as shown in FIG. 1.

Figure 21A:
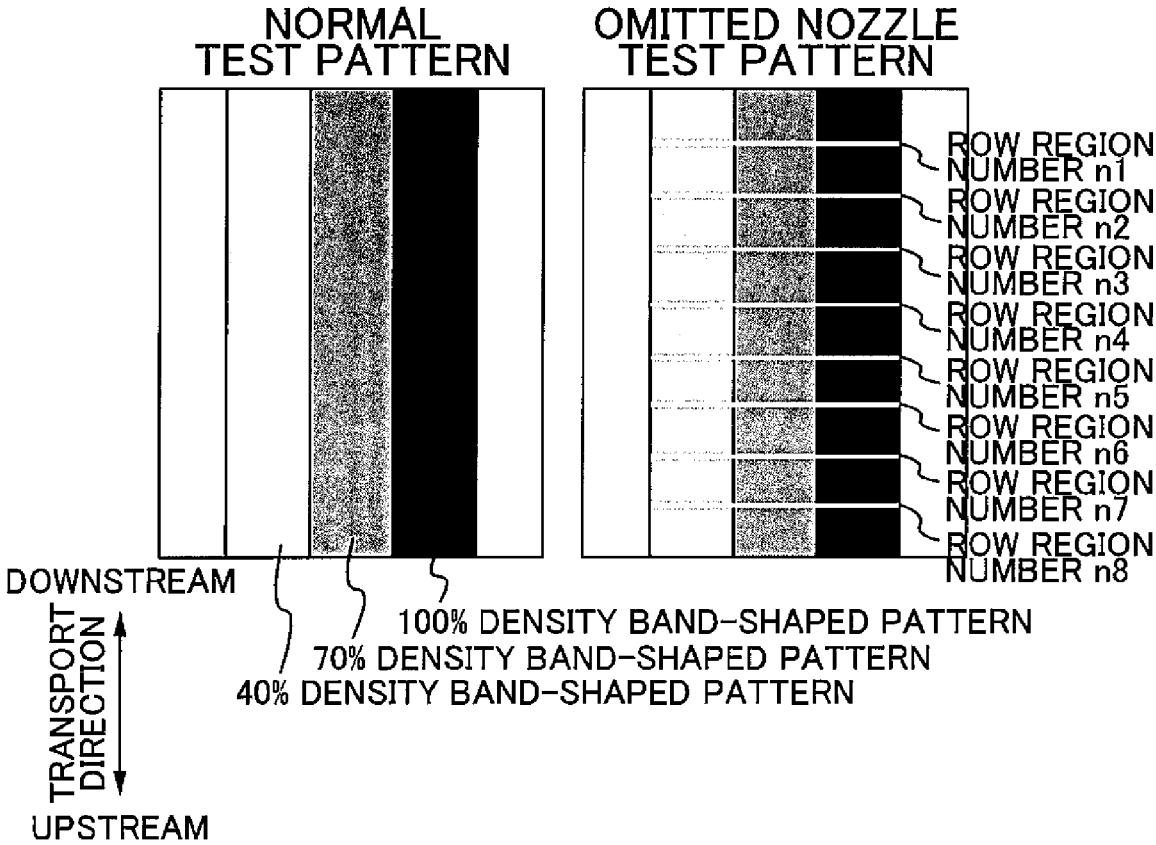
FIG. 21A shows a test pattern for calculating correction values R.

FIG. 21A shows a test pattern for calculating the correction values R. In order to calculate the correction values R, both a "normal test pattern (first test pattern)" and an "omitted nozzle test pattern (second test pattern)" are printed using the printer 1. Both the normal test pattern and the omitted nozzle test pattern are constituted by band-shaped patterns of three densities, an upper ruled line, a lower ruled line, a left ruled line, and a right ruled line, and are configured in a same manner as the correction pattern (FIG. 11B) for calculating the correction values H for intrinsic density irregularities. Furthermore, using the interlaced printing method, 30 raster lines are formed with leading edge printing and trailing edge printing, and 56 raster lines are formed with ordinary printing. Note however that the densities of the band-shaped patterns are different in the correction pattern of FIG. 11B and the test patterns of FIG. 21A. In the test patterns of FIG. 21A, the instructed tone value Sd=102 (40%), Se=179 (70%), and Sf=255 (100%). The correction values R for tone values other than the instructed tone values are calculated using linear interpolation based on the correction values R for the instructed tone values (described later). For this reason, very accurate correction values R can be calculated by calculating the correction value R for the highest tone value 255 and making uniform the intervals between each of the instructed tone values. It should be noted that a normal test pattern and an omitted nozzle test pattern are formed for each ink (YMCK).

Although the normal test pattern is formed assuming that all the nozzles are normal, the omitted nozzle test pattern is formed assuming that particular nozzles are faulty nozzles. That is, dots are intentionally not formed in particular row regions of the row regions that constitute the omitted nozzle test pattern. Dots are not formed in all eight row regions of the omitted nozzle test pattern, which creates an omitted nozzle condition. The row regions in which an omitted nozzle condition is created are an n1 number, an n2 number, . . . , and an n8 number row region from the downstream side in the transport direction. Furthermore, the nozzles assigned to each row region in which the omitted nozzle condition is to be created are all different nozzles. This is because if the nozzle assigned to each row region in which the omitted nozzle condition is to be created was the same nozzle, the characteristics of that nozzle would undesirably influence the correction values R to be calculated. Thus, as shown in FIG. 21A, the row region in which the omitted nozzle condition is created appears as a white streak on the omitted nozzle test pattern.

Figure 21B:
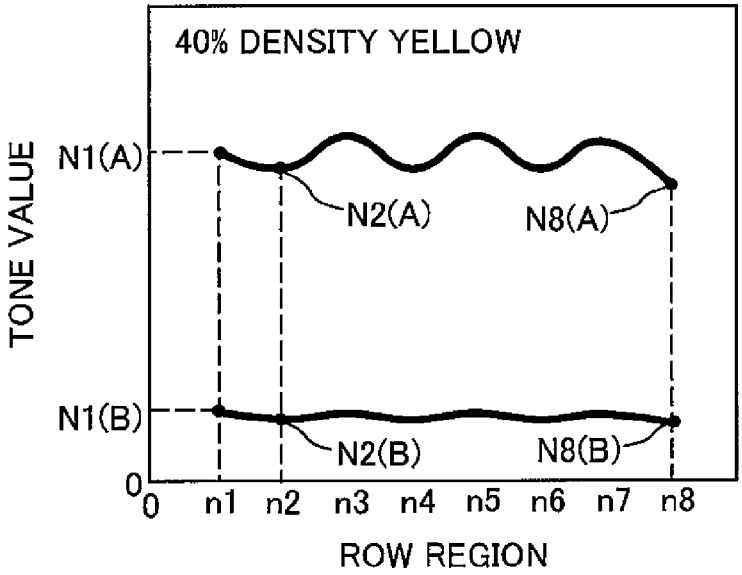
FIG. 21B shows tone values for row regions number n1 to number n8 in the normal test pattern and the omitted nozzle test pattern.

After printing the test pattern, the test pattern is read by the scanner 70. FIG. 21B shows (average) tone values for the row regions number n1 to number n8 in the normal test pattern and the omitted nozzle test pattern. After reading with the scanner 70, tone values of pixel rows corresponding to the eight row regions number n1 to number n8 in the normal test pattern (the plurality of pixels lined up in the x direction in the scanner coordinate system) and tone values of pixel rows corresponding to the eight row regions number n1 to number n8 in the omitted nozzle test pattern are calculated. A tone value of the pixel row corresponding to the row region number n1 in the normal test pattern is set as N1(A) and a tone value of the pixel row corresponding to the row region number n1 in the omitted nozzle test pattern is set as N1(B).

In this regard, the nozzle assigned to the row region number n1 in the omitted nozzle test pattern is assumed to be a faulty nozzle such that no dots are formed in the row region number n1. For this reason, compared to the tone value N1(A) of the pixel row corresponding to the row region number n1 in the normal test pattern, the tone value N1(B) of the pixel row corresponding to the row region number n1 in the omitted nozzle test pattern is a lower value. Similarly, for the row regions number n2 to number n8, compared to the tone values (N2(A) to N8(A)) in the normal test pattern, the tone values (N2(B) to N8(B)) in the omitted nozzle test pattern are lower values.

Next, an average value R'(A) of tone values of the pixel rows corresponding to the row regions number n1 to number n8 in the normal test pattern and an average value R'(B) of tone values of the pixel rows corresponding to the row regions number n1 to number n8 in the omitted nozzle test pattern are calculated for each ink (YMCK) and for each density (40%, 70%, and 100%).

$$R'(A)=(N1(A)+N2(A)+\ldots+N8(A)/8$$

$$R'(B)=(N1(B)+N2(B)+\ldots+N8(B))/8$$

Then, a ratio of the tone value (R'(A)) of the pixel row corresponding to the row region printed when the nozzle was normal to the tone value (R'(B)) of the pixel row corresponding to the row region printed when the nozzle was a faulty nozzle is set as a correction amount Rt. The correction amount Rt is expressed by the following formula.

$$Rt=R'(A)/R'(B)$$

For example, in a case where a row region printed in yellow ink with the instructed tone value Sd=102 (40% density) has been read by the scanner, the tone value of the pixel row corresponding to that row region will be R'(A) if the nozzle is normal. However, if the nozzle assigned to the row region is a faulty nozzle, then the tone value of the pixel row corresponding to that row region will be R'(B). That is, the density of an image piece printed by the normal nozzle will be Rt times the density of an image piece printed by the faulty nozzle.

Then, in the present embodiment, non-ejection density irregularities are remedied by multiplying by Rt the tone values of pixels adjacent to pixels to which a faulty nozzle has been assigned.

Furthermore, the printer 1 of the present embodiment carries out printing using an interlaced method. With interlaced printing, non-ejection density irregularities are remedied by correcting the tone values of the two pixels adjacent in the transport direction to a pixel to which a faulty nozzle has been assigned. That is, a single pixel in which a dot will not be formed is corrected by two adjacent pixels, and therefore a correction amount R for one adjacent pixel will be a value that is half the above-described correction amount Rt.

For example, in FIG. 18B, the nozzle assigned to the third row region is a faulty nozzle. If the nozzle assigned to the third row region was normal as in FIG. 18A, the density of the third row region in FIG. 18B would be Rt times that density. Accordingly, in the present embodiment, the density of the third row region is compensated by multiplying the tone values of the second and fourth row regions, which are adjacent to the third row region in the transport direction, respectively by Rt/2.

Figures 22A, 22B:
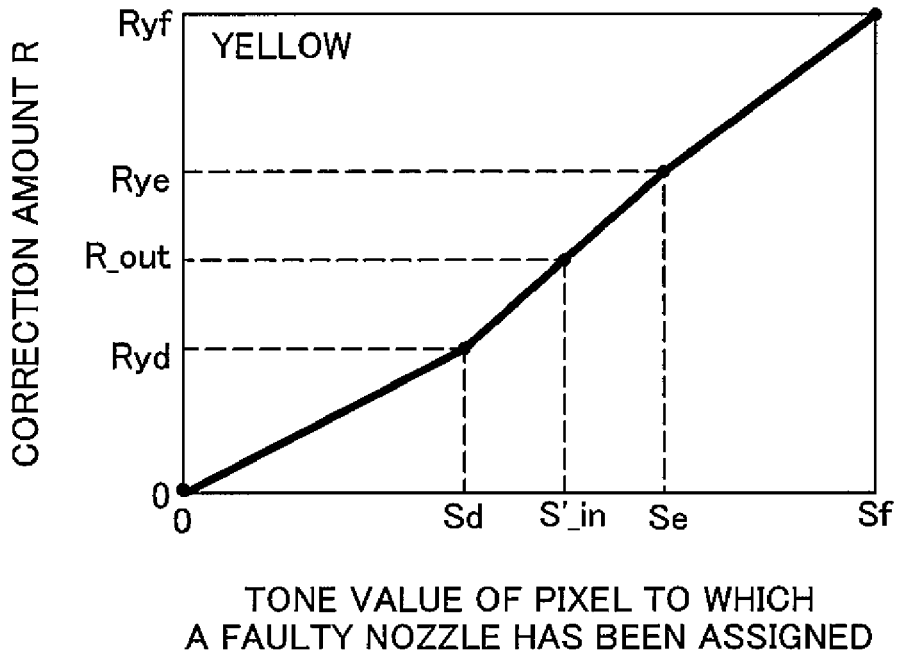
FIG. 22A is an explanatory diagram of a correction amount R table for non-ejection density irregularities.
FIG. 22B shows the correction amount R table in graph form.

FIG. 22A is an explanatory diagram of a correction amount R table for non-ejection density irregularities. The correction amount R is calculated for each ink (YMCK) and each instructed tone value (Sd, Se, and Sf). Furthermore, the correction amount R varies according to the printing method and is a value that is adjusted to the number of adjacent pixels (for the interlaced printing method, the correction amount R=Rt/2).

The correction amount R table generated in this manner is stored in the memory 53 of the printer 1. Then, in a same manner as the correction values H for intrinsic density irregularities, when the user has installed the printer driver on the computer 60, the correction amounts R for non-ejection density irregularities are sent to the computer 60 along with the correction values H. These are then stored in the memory of the computer 60, and when the user gives instruction for printing, a process for correcting non-ejection density irregularities (which is described later) is carried out by the printer driver.

FIG. 22B shows the correction amount R table in graph form. The horizontal axis indicates the tone value of pixels to which a faulty nozzle has been assigned and the vertical axis indicates the correction amount R. In a case where the tone value of a pixel to which a faulty nozzle has been assigned is 0, there is no need to increase the tone value of the adjacent pixels and the correction amount R is 0. And the value of the correction amount R is greater for higher tone values of pixels to which a faulty nozzle has been assigned. This is because when the tone value of a pixel to which a faulty nozzle has been assigned is high, the density of the region that would have been originally printed by the faulty nozzle is compensated by increasing the tone values of adjacent pixels by increasing the correction amount R for the tone values of adjacent pixels.

Regarding the Flow of Density Irregularity Corrections in the Present Embodiment Separate methods for remedying intrinsic density irregularities and non-ejection density irregularities were described above. In the present embodiment, the remedy for intrinsic density irregularities is carried out, then a further remedy for non-ejection density irregularities is carried out when a faulty nozzle has occurred. Hereinafter, description is given regarding a flow of a process for correcting the two types of density irregularities according to the present embodiment. A process for correcting density irregularities is carried out by the printer driver in a same manner as the foregoing process for correcting intrinsic density irregularities. It should be noted that in order to simplify description, the foregoing process for correcting intrinsic density irregularities was a description of correction processing for a case where only intrinsic density irregularities were remedied without non-ejection density irregularities occurring (a case where head cleaning is carried out was also included).

FIG. 23 shows a screen in which the user sets the printing method. The printer 1 of the present embodiment can be set to "high speed printing mode", "high quality image mode", and "standard mode". These are selected by the user.

In high speed printing mode, faulty nozzle testing is not carried out prior to printing. For this reason, the time for faulty nozzle testing and the cleaning time can be shortened, which enables printing to be performed quickly. However, when there is a faulty nozzle, image deterioration occurs.

In high quality image mode, faulty nozzle testing is carried out prior to printing, and cleaning is always carried out when there is a faulty nozzle. Since printing is carried out after the faulty nozzle is returned to a normal condition, non-ejection density irregularities do not occur. Note however that time is required to carrying out faulty nozzle testing and cleaning such that the printing time becomes undesirably longer.

In standard mode, faulty nozzle testing is carried out prior to printing, and cleaning is carried out depending on conditions (this is described later). Furthermore, in a case where cleaning is not carried out even though there is a faulty nozzle, the tone values of pixels adjacent to the pixels to which the faulty nozzle is assigned are corrected.

Figure 24:
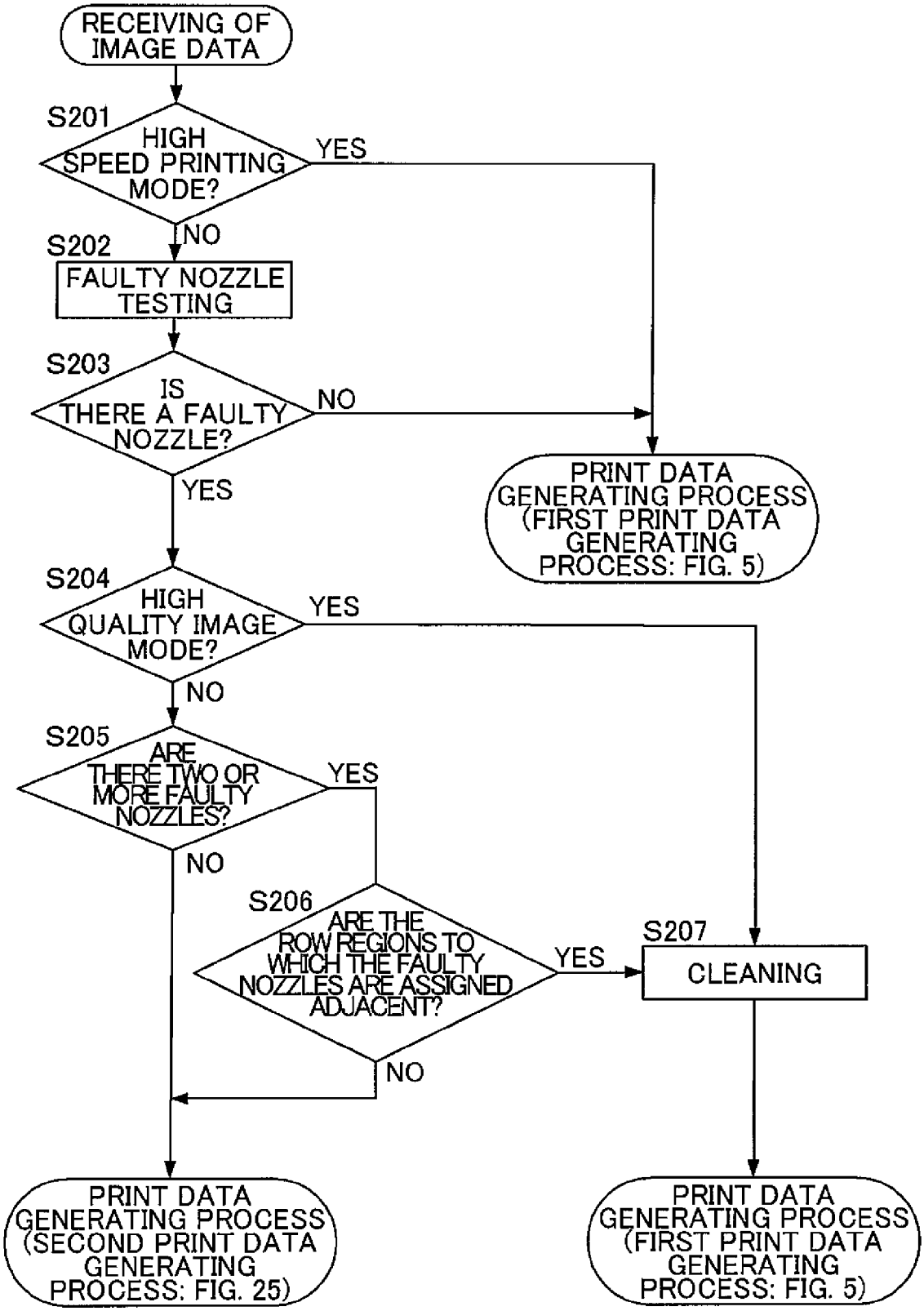
FIG. 24 is a flowchart of a process for correcting density irregularities.

FIG. 24 is a flowchart of a process for correcting density irregularities. First, upon receiving image data from the application program, the printer driver checks whether or not the printing mode is high speed printing mode (S201). If it is high speed printing mode (yes), then it commences a process for generating print data. In this case, the printer driver performs processing in accordance with the process flow for generating print data in FIG. 5 without carrying out head cleaning. Furthermore, in the case of high speed printing mode, correction is carried out for intrinsic density irregularities in the density correction process (S003) of FIG. 5, but correction is not carried out for non-ejection density irregularities even if there is a faulty nozzle. That is, a correction process is carried out only for the aforementioned intrinsic density irregularities. On the other hand, if it is not high speed printing mode (no), then faulty nozzle testing is carried out (S202).

Then, if there is no faulty nozzle (S203→no), then the printer driver generates print data in accordance with the flow of FIG. 5. If there is a faulty nozzle (S203→yes), then the printer driver checks whether or not the printing mode is high quality image mode (S204).

If the printing mode is high quality image mode (yes), then head cleaning is carried out. If the printing mode is not high quality image mode (no), then the printer driver checks the number of faulty nozzles (S205). If the number of faulty nozzles is one (no), then the remedy for non-ejection density irregularities is carried out without performing cleaning. Here, the process of generating print data in a case where the remedy for non-ejection density irregularities and the remedy for intrinsic density irregularities are carried out without performing cleaning is set as a second print data generating process. On the other hand, in a case where cleaning is carried out or in a case where there is no faulty nozzle, or in a case where faulty nozzle testing is not carried out, only the remedy for intrinsic density irregularities is carried out. The print data generating process in this case is as in the flow of FIG. 5, and is set as a first print data generating process. That is, if there is a single faulty nozzle, the second print data generating process (described later) is carried out.

Then, if the number of faulty nozzles is two or more (yes), then a check is made as to whether or not the row regions to which the faulty nozzles are assigned are adjacent (S206). Then, if the row regions to which the faulty nozzles are assigned are adjacent (yes), then head cleaning is carried out (S207).

Figure 18D:
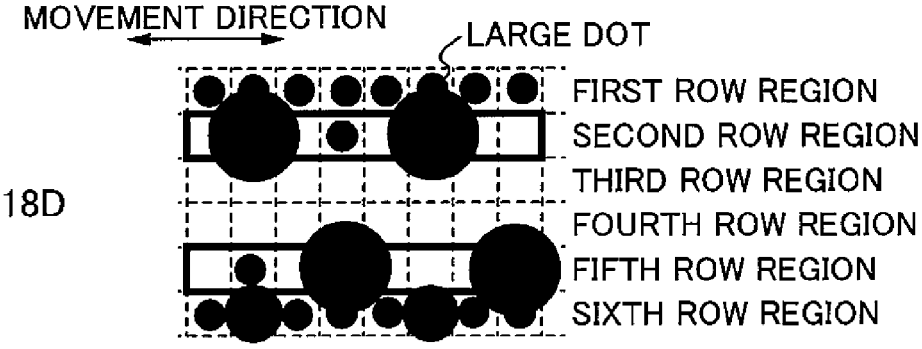
FIG. 18D shows a condition in which row regions to which faulty nozzles are assigned are adjacent.

FIG. 18D shows a condition in which row regions to which faulty nozzles are assigned are adjacent. For example, in a case where the nozzles assigned to the third and fourth row regions are faulty nozzles, there will be two row regions side by side in which no dots are formed, and a region having light density will be increased. For this reason, even if the tone values of the second and fifth row regions are corrected, it is difficult to compensate the densities of the third and fourth row regions. Accordingly, in the standard mode in the present embodiment, in a case where the row regions to which faulty nozzles are assigned are adjacent, head cleaning is carried out (S207). After this, the printer driver carries out the printer driver generating process in accordance with the flow of FIG. 5.

On the other hand, when there is a single faulty nozzle in standard mode (S205→no), or when the row regions to which the faulty nozzles are assigned are not adjacent (S206→yes), the second print data generating process is carried out. Next, description is given regarding the second print data generating process.

Figure 25:
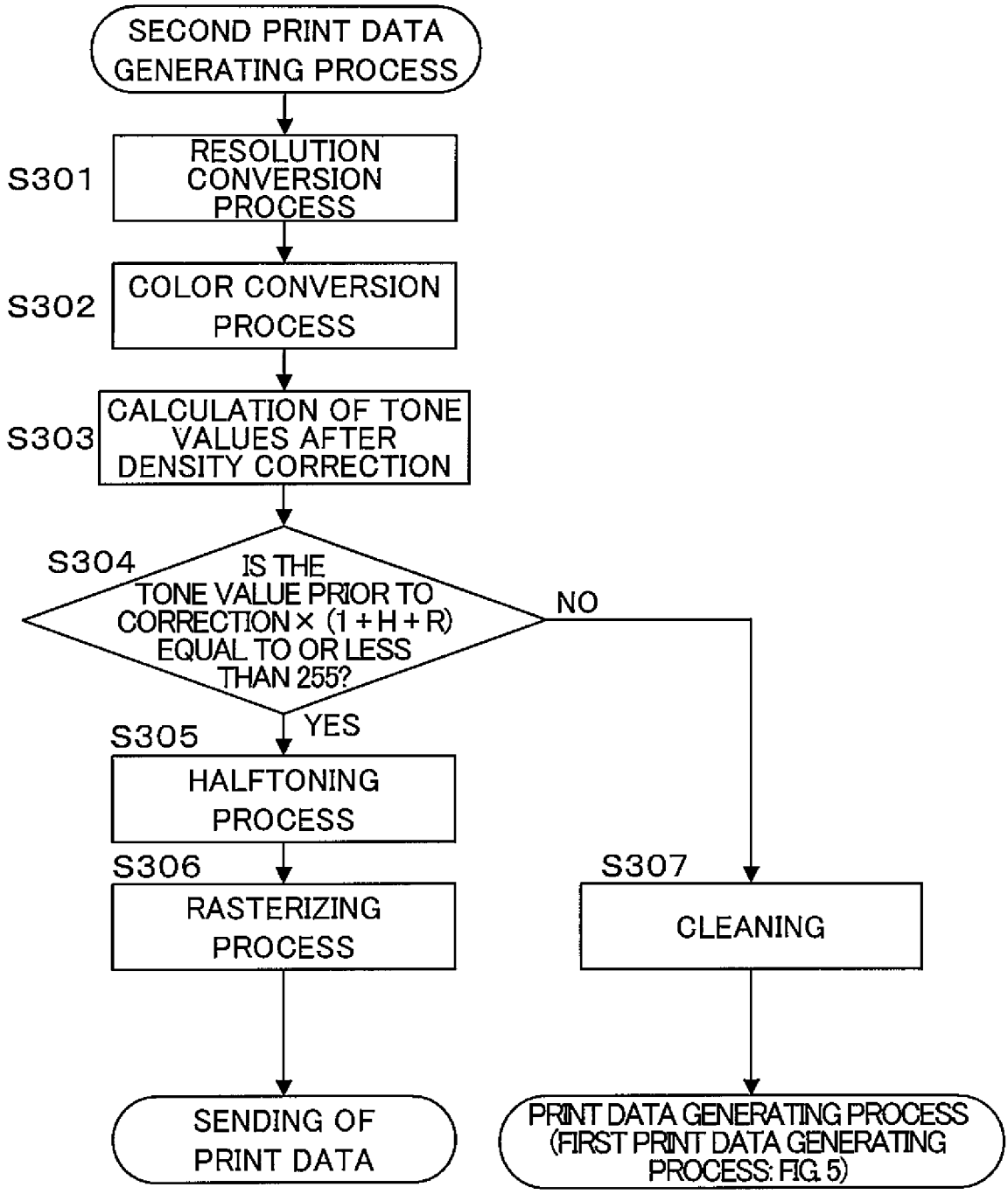
FIG. 25 is a flowchart of a second print data generating process.

FIG. 25 is a flowchart of the second print data generating process. First, the printer driver performs the resolution conversion process (S301) to convert the image data received from application software to a resolution for printing, and performs the color conversion process (S302) for converting RGB data to YMCK data.

Then corrections are carried out for intrinsic density irregularities and non-ejection density irregularities (S303). In the above-described process for correcting intrinsic density irregularities (FIG. 5, S003), the tone value S_out after correction is calculated by the following formula based on the tone value S_in prior to correction and the correction value H for intrinsic density irregularities.

$$S_out = S_in \times (1+H)$$

That is, in the first print data generating process (FIG. 5), the tone values of the pixels are corrected for the remedy for intrinsic density irregularities, but the tone values of the pixels are not corrected for the remedy for non-ejection density irregularities.

In contrast to this, in the second print data generating process (FIG. 25), the tone values of the pixels are corrected for the remedies for intrinsic density irregularities and non-ejection density irregularities. Then, the tone values S_out after correction (corrected tone values) for the pixels adjacent to the pixels to which a faulty nozzle has been assigned are calculated by correction values (second correction values=H+R) obtained by adding the correction values H for intrinsic density irregularities to the correction amount R for non-ejection density irregularities. It should be noted that the tone values S_out after correction (corrected tone values) are darker tone values than the tone values S_in prior to correction of the adjacent pixels.

$$S_out = S_in \times (1+H+R)$$

Note however that when the tone value of the pixels to which a faulty nozzle has been assigned is the same as any of the instructed tone values (Sd, Se, or Sf) when the test pattern of FIG. 21A was formed, the correction amount R of FIG. 22 can be used as it is for the adjacent pixels. For example, suppose that the yellow nozzle assigned to the third row region in FIG. 18B is a faulty nozzle and the tone value indicated by the third row region is Sd(=102, 40% density) . In this case, the tone values of the second and fourth row regions are corrected as in the following formula.

$$S_out = S_in \times (1+H+Ryd)$$

On the other hand, in a case where the tone value S'_in of pixels to which a faulty nozzle has been assigned is different from the instructed tone value as shown in FIG. 22B, it is necessary to first calculate the correction amount R_out corresponding to the tone value S'_in. The correction amount R_out is calculated in accordance with the following formula based on linear interpolation.

$$R_out = Ryd + (Rye - Ryd) \times \{(S_in - Sd)/(Se - Sd)\}$$

For example, in a case where the tone value of the pixels assigned to the third row region in FIG. 18B is S'_in, then the tone values of the second and fourth row regions are corrected as in the following formula.

$$S_out = S_in \times (1+H+R_out)$$

Suppose that at this time the tone value S_out after correction becomes larger than the highest tone value 255. An image based on image data having tone values larger than 255 cannot be printed. For this reason, when the tone value S_out after correction becomes larger than the highest tone value 255, non-ejection density irregularities cannot be remedied.

Consequently, a check is made as to whether or not the tone values S_out after correction are larger than 255 (S304), and if these are larger than 255 (no), then cleaning of the head 31 is carried out (S307). By doing this, the faulty nozzle becomes normal and it becomes unnecessary to carry out correction of non-ejection density irregularities for the tone values of adjacent pixels. As a result, it becomes possible to avoid the undesirability of the highest tone value becoming larger than 255. Then, after cleaning, the printer driver carries out the first print data generating process. Note however that in this case the resolution conversion process and the color conversion process have already been executed on the image data from the application software and therefore the procedure may proceed from the density correction process (S003).

On the other hand, if the tone values S_out after correction are not greater than 255 (yes), then the printer driver executes the halftoning process on the image data to convert it to data of four tones that can be formed by the printer 1 (S305). Then the printer driver carries out the rasterizing process (S306) in which image data in a matrix form is rearranged for each set of pixel data to an order suitable for transfer to the printer 1.

Thus, the print data generated in the first print data generating process or the second print data generating process is sent to the printer 1 together with print commands. Then an image in which intrinsic density irregularities or non-ejection density irregularities are not produced is printed by the printer 1.

In this way, with the present embodiment, reduced image quality can be avoided without carrying out cleaning when a faulty nozzle has occurred by correcting the tone values of pixels adjacent to pixels to which the faulty nozzle has been assigned. Since cleaning is not carried out, the printing time is shortened and consumption of ink used in cleaning can be suppressed.

If the printer 1 only held correction values H for intrinsic density irregularities, then when a faulty nozzle occurred during use by the user, streaks would be produced undesirably in the image and the effect of correcting intrinsic density irregularities would be lessened. For this reason, by holding both the correction values H for intrinsic density irregularities and the correction amounts R for non-ejection density irregularities as in the present embodiment, deterioration in image quality can be avoided without carrying out cleaning.

Furthermore, in the present embodiment, when there is a faulty nozzle, corrections can be carried out on both types of density irregularities simply by adding the correction amounts R for non-ejection density irregularities to the correction values H for intrinsic density irregularities ($S_out=S_in\times(1+H+R)$. That is, the correction process does not become complicated even though corrections are carried out for the two types of density irregularities.

In this embodiment, the correction method for non-ejection density irregularities can be selected by the user according to the circumstance. For example, in a case where the user desires to print quickly even though the image quality will be worsened, printing can be performed without carrying out faulty nozzle testing. Conversely, in a case where the user desires to print a high quality image even though this takes time, it is possible to always carry out head cleaning whenever there is a faulty nozzle.

Second Embodiment: Overlap Printing System

With the foregoing embodiment, description was given regarding a method of remedying non-ejection density irregularities in the interlaced printing method when the printer 1 carried out printing using the interlaced printing method. In a second embodiment, description is given regarding a method of remedying non-ejection density irregularities in an overlap printing method when the printer 1 carries out printing using the overlap printing method.

Regarding Overlap Printing

Figure 26A:
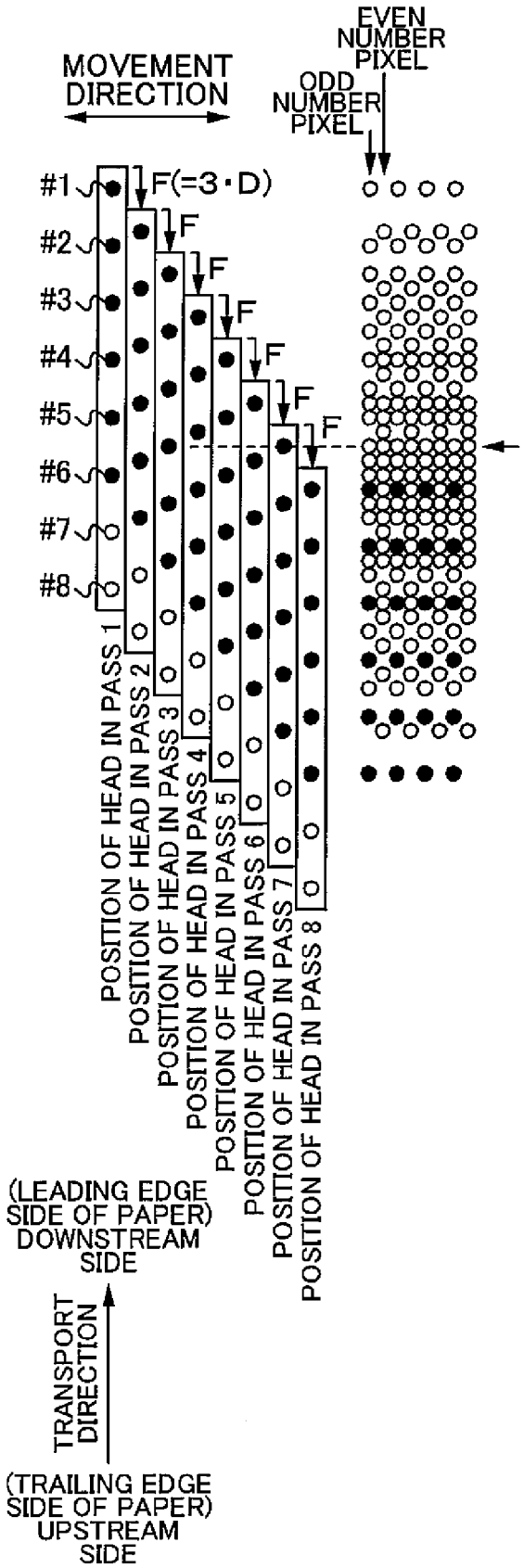
FIG. 26A and FIG. 26B are explanatory diagrams of overlap printing.
Figure 26B:
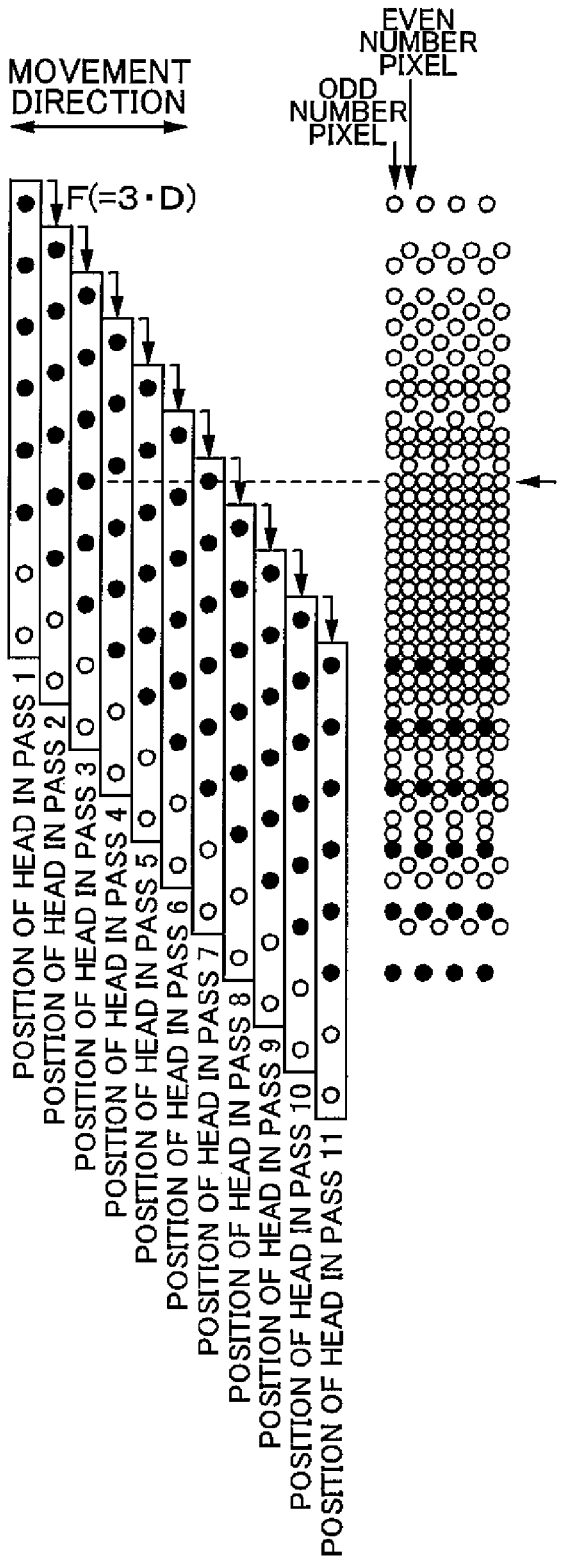

FIG. 26A and FIG. 26B are explanatory diagrams of overlap printing. FIG. 26A shows the positions of the head and how dots are formed in passes 1 to 8, and FIG. 26B shows the positions of the head and how dots are formed in passes 1 to 11. "Overlap printing" is a printing method in which a raster line is formed by a plurality of nozzles.

In overlap printing, each time the paper S is transported by a constant transport amount F in the transport direction, the nozzles form dots intermittently at every several dots. Then, in another pass, dots are formed by other nozzles to complement (to fill in the space between) the intermittent dots that have already been formed. In this way, a single raster line is formed by a plurality of nozzles.

Forming a single raster line in this manner in M passes is defined by an "overlap number M." In FIGS. 26A and 26B, since dots are formed intermittently at every other dot, dots are formed in every pass either at odd-numbered pixels or at even-numbered pixels. And, since a single raster line is formed by two nozzles in these drawings, the overlap number is M=2. Furthermore, in overlap printing, the following conditions are necessary in order to carry out recording with a constant transport amount: (1) N/M is an integer, (2) N/N and k are co-prime, and (3) the transport amount F is set to $(N/M)\cdot D$.

For example, in FIGS. 26A and 26B, each nozzle row has eight nozzles arranged in the transport direction. However, since the nozzle pitch k=4, the condition that "N/M and k are co-prime" is not met. Accordingly, six of the eight nozzles are used to perform overlap printing. That is, N=6 and the paper S is transported by a transport amount $3\cdot D$. As a result, using a nozzle row with a nozzle pitch of 180 dpi ($4\cdot D$) for example, dots are formed on the paper with a dot spacing of 720 dpi(=D).

Regarding Non-Ejection Density Irregularities in Overlap Printing

Figure 27A:
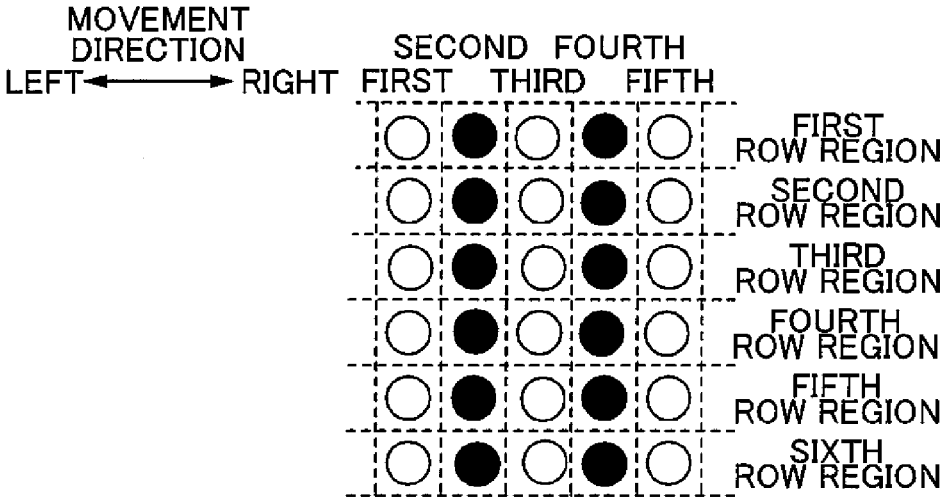
FIG. 27A shows dots formed in an ideal manner using overlap printing.
Figure 27B:
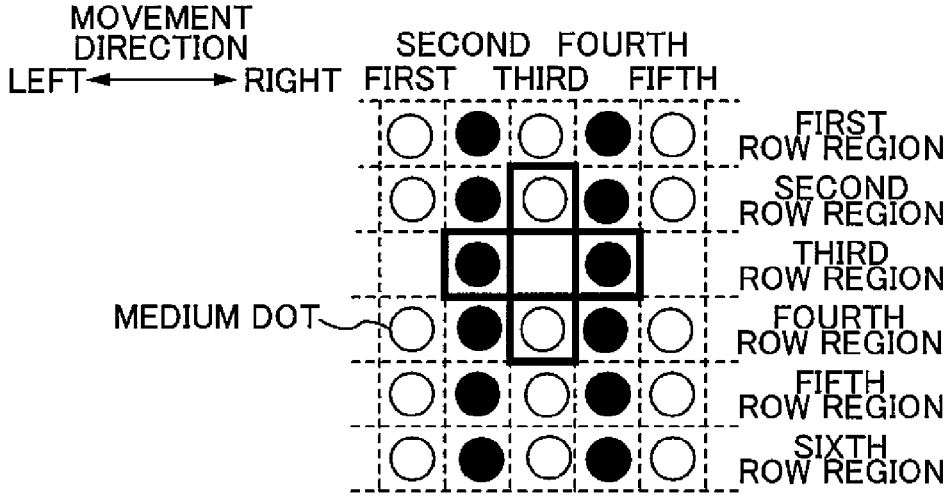
FIG. 27B shows dots not formed in an odd numbered pixel of a third row region due to a faulty nozzle.

FIG. 27A shows dots formed in an ideal manner using overlap printing. FIG. 27B shows dots not formed in an odd numbered pixel of the third row region due to a faulty nozzle. Unlike interlaced printing, in overlap printing, a single raster line is formed by two or more nozzles. For this reason, even if one nozzle among a plurality of nozzles assigned to form dots in a certain row region has become a faulty nozzle, it is possible to avoid a case where no dots at all are formed in the certain row region as long as ink is ejected normally from the other nozzles. Note however that even though streaks can be prevented from occurring in the image, the density of the row region to which the faulty nozzle is assigned will become lighter, and shading differences with the other row regions will result in density irregularities.

Regarding Remedying Non-Ejection Density Irregularities in Overlap Printing

In the foregoing embodiment, two methods were put forth for remedying non-ejection density irregularities, namely a method involving cleaning the nozzle face of the head, and a method involving correcting the tone values of adjacent pixels. Even though the printing method is different, the method of remedying non-ejection density irregularities by cleaning is the same. However, in the interlaced printing method and the overlap printing method, the pixels adjacent to pixels to which a faulty nozzle has been assigned (adjacent pixels) are different. Accordingly, hereinafter description is given regarding a method of correcting tone values of adjacent pixels in overlap printing.

Figure 27C:
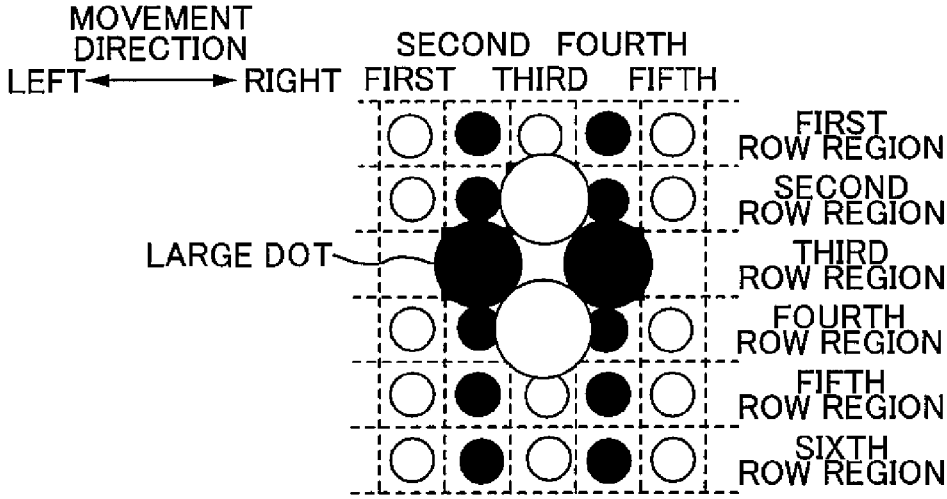
FIG. 27C illustrates a method of correcting tone values of adjacent pixels in overlap printing.

FIG. 27C illustrates a method of correcting tone values of adjacent pixels in overlap printing. Since a single raster line is formed by a single nozzle in interlaced printing, non-ejection density irregularity cannot be remedied by correcting the tone values of pixels adjacent in the movement direction to pixels to which a faulty nozzle has been assigned. In contrast with this, with overlap printing, a single raster line is formed using two or more nozzles. For this reason, if there is a single faulty nozzle, then the nozzles of pixels adjacent in the movement direction to pixels to which the faulty nozzle has been assigned will be normal nozzles. Furthermore, with overlap printing, a nozzle assigned to a certain row region is different from a nozzle assigned to a row region adjacent in the transport direction to the certain row region. That is, with overlap printing, non-ejection density irregularities are remedied by correcting the tone values of the pixels adjacent in the transport direction and the movement direction to a pixel to which a faulty nozzle has been assigned.

Suppose that a nozzle assigned to a pixel third from the left in the third row region (hereinafter referred to as "third pixel") is a faulty nozzle as shown in FIG. 27B. The pixels adjacent in the movement direction to the third pixel are the pixels second and fourth from the left in the third row region. The pixels adjacent in the transport direction to the third pixel are a pixel third from the left in the second row region and a pixel third from the left in the fourth row region. For example, the non-ejection density irregularities are remedied by increasing the tone values of the four pixels adjacent to the third pixel in the transport direction and the movement direction as shown in FIG. 27C to change the dots formed in the four adjacent pixels from medium dots to large dots.

That is, in a case where a single raster line is formed by two or more nozzles as in overlap printing, non-ejection density irregularity is remedied by correcting the tone values of pixels adjacent in the transport direction and the movement direction to the pixel at which a faulty nozzle has been assigned to form a dot. Furthermore, since a single pixel in which a dot will not be formed is corrected by four adjacent pixels, the correction amount R for one adjacent pixel will be a value that is ¼ the above-described correction amount Rt.

Other Embodiments

The foregoing embodiments gave description mainly regarding a printing system having an inkjet method printer, and included disclosure of methods of remedying density irregularities for example. Furthermore, the foregoing embodiments are merely for facilitating the understanding of the present invention, and are not meant to be interpreted in a manner limiting the scope of the present invention. Naturally the invention can be modified and improved without departing from the gist thereof and includes functional equivalents. In particular, embodiments described below are also included in the invention.

Regarding the Printer 1

In the foregoing embodiments, description was given using as an example a printer (serial printer) that forms raster lines while the head 31 moves in the movement direction, but there is no limitation to this. For example, the present invention also applies to a line head printer in which an image is accomplished by ejecting ink from nozzles lined up in a direction (paper width direction) intersecting a transport direction onto a paper that is transported in the transport direction without stopping. In this case, the raster lines are formed along the transport direction and the row regions refer to regions constituted by regions of a plurality of pixels lined up in the transport direction.

Since the nozzles of a line head printer are lined up in the paper width direction, the number of nozzles is greater compared to a serial type printer. For this reason, time is used in moving the nozzles of the line head printer to the non-print area for cleaning. Furthermore, since there are a great number of nozzles, the proportion of the number of nozzles that are not blocked becomes greater and there is a high probability that ink will be consumed to no purpose when carrying out cleaning. That is to say, for a line head printer that takes time for cleaning and consumes a large amount of ink in cleaning, the present invention involving remedying faulty nozzles without carrying out cleaning is an effective invention.

Furthermore, in the printer of the foregoing embodiments, a voltage was applied to a drive element (piezo element) to expand/contract an ink chamber in order to eject a liquid, but there is no limitation to this. For example, a printer (thermal jet method) may be used in which a bubble is produced inside the nozzle using a heating element and a liquid is ejected by that bubble.

Regarding the Liquid Ejecting Apparatus

In the foregoing embodiments, an inkjet printer was shown as an example as part of a liquid ejecting apparatus that executes a liquid ejecting method, but there is no limitation to this. As long as it is a liquid ejecting apparatus, the present invention may be applied to various industrial apparatuses that are not printers (printing apparatuses). For example, the present invention can also be applied to apparatuses such as a textile apparatus for applying a pattern to a fabric, a color filter manufacturing apparatus, an apparatus for manufacturing displays such as organic EL displays, a DNA chip manufacturing apparatus that manufactures a DNA chip by applying a solution in which DNA is dissolved onto a chip, and a circuit board manufacturing apparatus. Furthermore, in the foregoing embodiments, since the printer driver in the computer 60 carried out the density correction processing, the liquid ejecting apparatus involved the computer 60 on which the printer driver was installed and the printer 1 connected to the computer 60. However, in a case where the CPU 52 on the printer side performs the role of the printer driver, the printer only is the liquid ejecting apparatus.

Regarding Cleaning

In the foregoing embodiments, whether or not row regions to which faulty nozzles were assigned were adjacent (FIG. 26, S206) was a standard for determining performing cleaning, but there is no limitation to this. For example, cleaning may be set to be carried out in a case where an X number or more of faulty nozzles have been detected.

Regarding Remedying Intrinsic Density Irregularities

In the foregoing embodiments, a method was carried out for remedying intrinsic density irregularities produced by problems such as the processing precision of the nozzles. However, as long as a remedy for non-ejection density irregularities is carried out without performing cleaning, the method for remedying intrinsic density irregularities may not necessarily be carried out.

In this case, the tone values S_in prior to correction are multiplied by the correction amount R to correct the tone values of adjacent pixels ($S_out=S_in\times(1+R)$). However, the effect of remedying non-ejection density irregularities is weakened undesirably by intrinsic density irregularities.

Regarding Correction Amount R

In the foregoing embodiments, non-ejection density irregularities were remedied by calculating the correction amount R according to a ratio of tone values of pixels of an omitted nozzle to normally printed pixels then multiplying the tone values S_in prior to correction by the correction amount R, but there is no limitation to this. For example, it is also possible to calculate a correction amount from a difference in tone values between pixels of an omitted nozzle and normally printed pixels then adding the correction amount to the tone values prior to correction.

Figure 28:
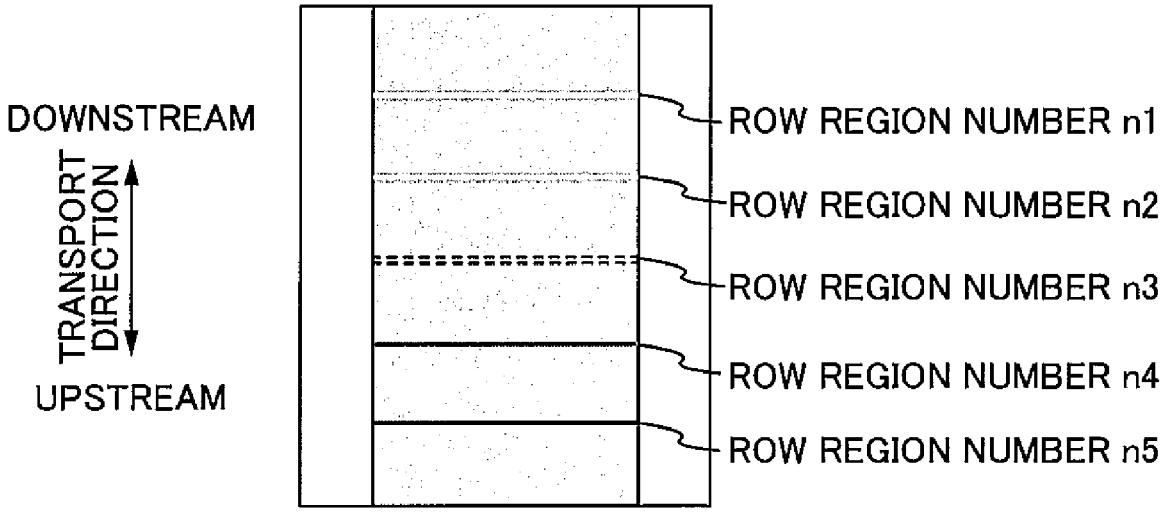
FIG. 28 shows a test pattern printed after tone values of row regions adjacent to a row region in an omitted nozzle condition have been corrected by a candidate value R' of the correction amount R.

Furthermore, in the foregoing embodiments, the normal test pattern and the omitted nozzle test pattern were formed to calculate the correction amounts R, but there is no limitation to this. For example, a test pattern may be formed by determining in advance a number of candidate values R' of the correction amount R. FIG. 28 shows a test pattern printed after tone values of row regions adjacent to a row region (a row region of a number n1 to a number n5) in an omitted nozzle condition have been corrected by a candidate value R' of the correction amount R. The tone values of a row region adjacent to the row region number n1 are corrected using a comparatively small candidate value R', and the tone values of a row region adjacent to the row region number n5 are corrected using a comparatively large candidate value R'. For this reason, the density of the row region number n1 becomes lighter compared to other row regions and the density of the row region number n5 becomes darker compared to other row regions. Then the tone values of the row regions number n1 to number n5 are measured to determine the row region close to the tone values of the row regions printed using normal nozzles. For example, in FIG. 28, the density of the row region number n3 is closest to the density of the other row regions, and therefore the candidate value R' used in the row region adjacent to the row region number n3 is set as the correction amount R.

What is claimed is:

1. A liquid ejecting method, comprising:

detecting a faulty nozzle in which an ejection fault occurs when a liquid should be ejected;

forming a first test pattern using nozzles that do not include the faulty nozzle;

forming a second test pattern using nozzles that include the faulty nozzle, wherein the liquid is deliberately not ejected from the faulty nozzle;

detecting a density of the first test pattern;

detecting a density of the second test pattern;

calculating a correction amount using the density of the first test pattern and the density of the second test pattern;

correcting tone values of pixels adjacent to pixels at which the liquid should be ejected from the faulty nozzle based on the correction amount; and ejecting the liquid with a liquid ejecting apparatus to the adjacent pixels based on the corrected tone values.

2. A liquid ejecting method according to claim 1, wherein the corrected tone values are tone values darker than tone values of the adjacent pixels.

3. A liquid ejecting method according to claim 1, wherein the liquid ejecting apparatus forms the first and second test patterns in which pixel rows are lined up in a direction that intersects a predetermined direction, each of the pixel rows having a plurality of pixels lined up in the predetermined direction, each of the pixels indicating a same instructed tone value, the first and second test patterns are read by a scanner and a read tone value is obtained for each pixel row, a first correction value for each pixel row is calculated from the read tone value and the instructed tone value, tone values indicating the pixel rows are corrected using the first correction value, the liquid is ejected to the pixel rows based on the corrected tone values, and when the faulty nozzle is detected, the tone values of the adjacent pixels are corrected by second correction values in which the correction amounts have been added to the first correction values, and the corrected tone values are calculated.

4. A liquid ejecting method according to claim 3, wherein when there is only a single nozzle that ejects the liquid in the pixel row, the adjacent pixels are pixels adjacent in a direction intersecting pixels at which the liquid should be ejected from the faulty nozzle.

5. A liquid ejecting method according to claim 3, wherein when there are two or more nozzles that eject the liquid in the pixel row, the adjacent pixels are pixels adjacent in the predetermined direction and the intersecting direction to pixels at which the liquid should be ejected from the faulty nozzle.

6. A liquid ejecting method according to claim 1, wherein when non-ejection pixel rows, which are pixel rows in which the liquid is not ejected, are multiple in the second test pattern, nozzles associated with the plurality of non-ejection pixel rows are respectively different nozzles.

7. A liquid ejecting method according to claim 1, wherein the correction amounts are set such that as tone values of the corrected tone values become darker as the tone values of pixels at which the liquid should be ejected from the faulty nozzle become darker.

8. A liquid ejecting method according to claim 1, wherein when nozzles assigned to the adjacent pixels are the faulty nozzle, a recovery process is carried out so that liquid is ejected normally from the faulty nozzle.

9. A liquid ejecting method according to claim 1, wherein the corrected tone values are calculated by adding the correction amounts to the tone values of the adjacent pixels.

10. A liquid ejecting apparatus, comprising:

a faulty nozzle detection mechanism that detects a faulty nozzle in which an ejection fault occurs when a liquid should be ejected;

nozzles that eject a liquid to form a first test pattern using nozzles that do not include the faulty nozzle, and to form a second test pattern using nozzles that include the faulty nozzle, wherein the liquid is deliberately not ejected from the faulty nozzle;

a density detection mechanism for detecting a density of the first test pattern and a density of the second test pattern; and a controller that calculates a correction amount using the density of the first test pattern and the density of the second test patter, and that corrects tone values of pixels adjacent to pixels at which the liquid should be ejected from the faulty nozzle based on the correction amount, and that causes to eject the liquid at the adjacent pixels based on the corrected tone values.

* * * * *